US012179972B2

(12) United States Patent
McLeod

(10) Patent No.: US 12,179,972 B2
(45) Date of Patent: Dec. 31, 2024

(54) CONTAINERS HAVING FOLDING TOPS AND BLANKS THEREFOR

(71) Applicant: WESTROCK SHARED SERVICES, LLC, Atlanta, GA (US)

(72) Inventor: Michael McLeod, Romeoville, IL (US)

(73) Assignee: WestRock Shared Services, LLC, Atlanta, GA (US)

( * ) Notice: Subject to any disclaimer, the term of this patent is extended or adjusted under 35 U.S.C. 154(b) by 156 days.

(21) Appl. No.: 17/524,662

(22) Filed: Nov. 11, 2021

(65) Prior Publication Data

US 2022/0144483 A1 May 12, 2022

Related U.S. Application Data

(60) Provisional application No. 63/112,557, filed on Nov. 11, 2020.

(51) Int. Cl.
*B65D 5/54* (2006.01)
*B65D 5/66* (2006.01)

(52) U.S. Cl.
CPC ..... *B65D 5/5455* (2013.01); *B65D 5/548* (2013.01); *B65D 5/6658* (2013.01)

(58) Field of Classification Search
CPC .... B65D 5/5455; B65D 5/548; B65D 5/6658; B65D 5/443; B65D 5/546; B65D 5/2033; B65D 5/18; B65D 5/2014; B65D 5/547; B65D 5/66; B65D 5/6608; B65D 2571/0066; B65D 2571/00728; B65D 5/28; B65D 2571/00839; B65D 2571/00895; B65D 5/02
(Continued)

(56) References Cited

U.S. PATENT DOCUMENTS 2,819,833 A * 1/1958 Sauer ..... B65D 5/2033 229/109
4,765,534 A * 8/1988 Zion ..... B65D 5/6655 229/196

(Continued)

*Primary Examiner* — Christopher R Demeree

(74) *Attorney, Agent, or Firm* — Neil G. Cohen; Rohini K. Garg

(57) ABSTRACT

A blank for forming a package can include a base panel, a first base side panel foldably connected to the base panel, a plurality of first base side flaps foldably connected to the first base side panel, a second base side panel foldably connected to the base panel opposite the first base side panel, and a plurality of second base side flaps foldably connected to the second base side panel. The blank can include a hinge panel foldably connected to the base panel, a top panel foldably connected to the hinge panel, a first top side panel foldably connected to the top panel, a plurality of first top side flaps foldably connected to the first top side panel, a second top side panel foldably connected to the top panel opposite the first top side panel, and a plurality of second top side flaps foldably connected to the second top side panel. An end first base side flap and an end first top side flap can be formed and separated by a first cut line such that the end first base side flap and the end first top side flap are abutting each other, and an end second base side flap and an end second top side flap can be formed and separated by a second cut line such that the end second base side flap and the end second top side flap are abutting each other.

19 Claims, 47 Drawing Sheets

2500

(58) Field of Classification Search
USPC ..... 229/131.1, 109, 108, 110, 126, 185.1, 229/193
See application file for complete search history.

(56) References Cited

U.S. PATENT DOCUMENTS

| | | | | | |
|---|---|---|---|---|---|
| 5,263,634 | A * | 11/1993 | Korine | B65D 5/2019 | 229/906 |
| 5,295,623 | A * | 3/1994 | Bacques | B65D 71/36 | 53/448 |
| 5,351,880 | A * | 10/1994 | Goudreau | B65D 85/36 | 229/120.32 |
| 6,223,978 | B1 * | 5/2001 | Drager | B65D 5/2033 | 493/162 |
| 8,459,532 | B2 * | 6/2013 | Stephens | B65D 85/06 | 229/137 |
| 2023/0271744 | A1 * | 8/2023 | McLeod | B65D 71/36 | 229/108 |

* cited by examiner

700

800

800

1000

1000

1100

1200

1200

1300

1400

1500

1600

1700

1800

1800

1900

2000

2100

2200

2300

2400

2400

2500

2600

2600

2600

2700

2800

2800

CONTAINERS HAVING FOLDING TOPS AND BLANKS THEREFOR

FIELD

This disclosure relates to containers having folding tops and blanks therefor.

BACKGROUND

Traditional container designs do not maximize material efficiency and strength. Conventional methods and systems have generally been considered satisfactory for their intended purpose. However, there is still a need in the art for improved containers and blanks therefor. The present disclosure provides a solution for this need.

SUMMARY

A blank for forming a package can include a base panel, a first base side panel foldably connected to the base panel, a plurality of first base side flaps foldably connected to the first base side panel, a second base side panel foldably connected to the base panel opposite the first base side panel, and a plurality of second base side flaps foldably connected to the second base side panel. The blank can include a hinge panel foldably connected to the base panel, a top panel foldably connected to the hinge panel, a first top side panel foldably connected to the top panel, a plurality of first top side flaps foldably connected to the first top side panel, a second top side panel foldably connected to the top panel opposite the first top side panel, and a plurality of second top side flaps foldably connected to the second top side panel. An end first base side flap and an end first top side flap can be formed and separated by a first cut line such that the end first base side flap and the end first top side flap are abutting each other, and an end second base side flap and an end second top side flap can be formed and separated by a second cut line such that the end second base side flap and the end second top side flap are abutting each other.

The plurality of first and second base side flaps can include two side flaps foldably connected to each other on each side of the first and second base side panel, respectively. Any other suitable number of panels is contemplated herein.

The blank can include a base side panel fold line 119*a, b* between each base side panel and the base, and a hinge panel base fold line between the base panel and the hinge panel. Each base side panel fold line 119*a, b* between each base side panel and the base panel can be perpendicular relative to the hinge panel base fold line between the base and the hinge panel.

The blank can include a base side flap fold line between adjacent base side flaps, and a base side panel flap fold line between each base side panel and each adjacent base side flap. Each base side flap fold line and each base side panel flap fold line can be parallel with the hinge panel base fold line.

The plurality of first and second top side flaps can include one top side flap foldably connected to each side of the first and second top side panel, respectively. Any other suitable number of top side flaps is contemplated herein.

The blank can further include a top side panel fold line between each top side panel and the top panel. The blank can also include a hinge panel top fold line between the top panel and the hinge panel. Each top side panel fold line between each top side panel and the top panel can be perpendicular relative to the hinge panel top fold line between the top and the hinge panel.

The blank can include a top side panel flap fold line between each top side panel and each top side flap. Each top side panel flap fold line can be parallel with the hinge panel top fold line. Each top side panel fold line can be collinear with a respective base side panel fold line 119*a, b*.

The base panel and the top panel can be the same shape and dimensions. In certain embodiments, the base panel and the top panel can be octagonal. In certain embodiments, the hinge panel, all side panels, and all side flaps can be rectangular. The hinge panel and each side panel can have the same length dimension extending away from the base panel and/or the top panel, respectively (e.g., to have the same height when formed).

The blank can further include one or more front side panels foldably connected to the base panel and/or the top panel opposite the hinge panel. In certain embodiments, the one or more front side panels can include a top front panel foldably connected to the top panel, and a base front panel foldably connected to the base panel. The top front panel and base front panel can be dimensioned to have a combined length dimension extending away from the base panel and the top panel equal to or less than the hinge panel.

In certain embodiments, the one or more front side panels can include a top front panel foldably connected to the top panel, and a base front panel foldably connected to the base panel, and the base front panel can include a length dimension extending away from the base panel equal to the hinge panel. In certain embodiments, the one or more front side panels can include a base front panel foldably connected to the base panel and an attachment panel foldably connected to the base front panel opposite the base panel, and the base front panel can include a length dimension extending away from the base panel equal to the hinge panel.

In certain embodiments, the blank can include a tearaway line defined in the top panel and/or the top front panel and/or the base front panel (e.g., a weakened line such as a perforated line). Any other suitable additional features, fold line, cut lines, and/or weakened lines are contemplated herein.

In accordance with at least one aspect of this disclosure, a package can be formed from any suitable embodiment of a blank disclosed herein, e.g., as described above. In certain embodiments, a full overlay (FOL) package (e.g., formable from certain embodiments of a blank disclosed herein) can include an octagonal shaped base. The FOL package can be formed from a single blank and can have a total of 12 or more weight bearing corners, for example. In certain embodiments, the number of weight bearing corners can be 12, 14, or 16. Any other suitable number is contemplated herein. In certain embodiments, the package can include a six sided top panel and other panels configured to cover the octagaonal shaped base such that a handle panel creates a space between a side of the octagonal shaped base and the handle panel to create a finger space for inserting fingers into a handle hole. Any other suitable additional features are contemplated herein. In accordance with at least one aspect of this disclosure, a blank can be configured to form any suitable embodiment of a package as disclosed herein, e.g., as described above.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein:

FIGS. 26A, 26B, and 26C show perspective views of a package formed from the blank of FIG. 25, shown in a closed position in different orientations, wherein FIGS. 26B and 26C show handles torn away and punched in such that the package forms an enclosed handle space separate from an interior space of the package;

DETAILED DESCRIPTION

Figure 1:
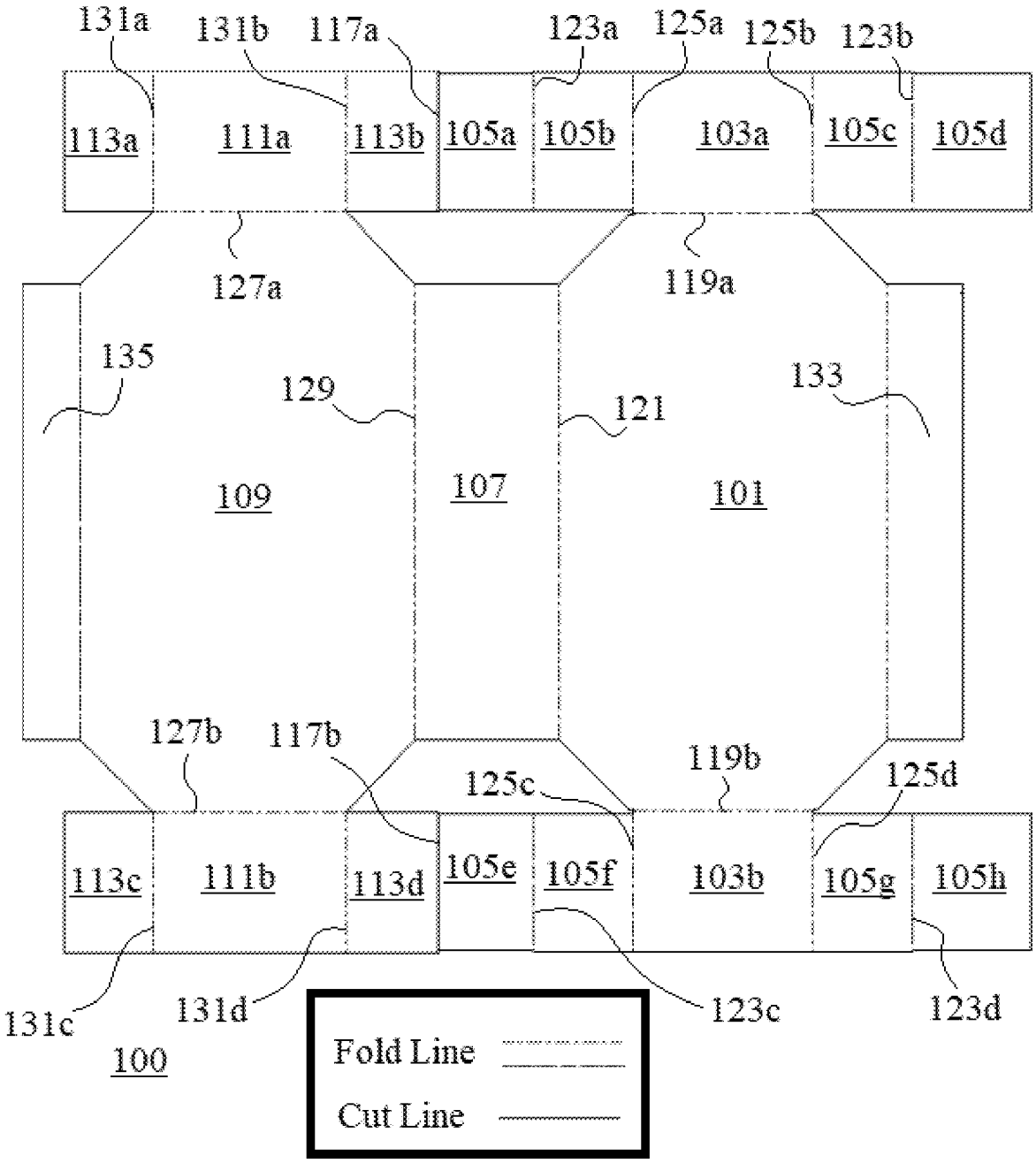
FIG. 1 is a schematic view of an embodiment of a blank accordance with this disclosure.

Reference will now be made to the drawings wherein like reference numerals identify similar structural features or aspects of the subject disclosure. For purposes of explanation and illustration, and not limitation, an illustrative view of an embodiment of a blank in accordance with the disclosure is shown in FIG. 1 and is designated generally by reference character 100. Other embodiments and/or aspects of this disclosure are shown in FIGS. 2A-28B. Certain embodiments described herein can be used for efficient machine forming, to reduce waste by minimizing cut out material, and/or to increase strength of packages, and/or for any other suitable use.

Referring to FIG. 1-6B, for example, a blank 100, 300, 500 for forming a package 200, 400, 600 can include a base panel, a first base side panel 103*a* foldably connected to the base panel 101, a plurality of first base side flaps 105*a, b, c, d* foldably connected to the first base side panel 103*a*, a second base side panel 103*b* foldably connected to the base panel 101 opposite the first base side panel 103*a*, and a plurality of second base side flaps 105*e, f, g, h* foldably connected to the second base side panel 103*b*. The blank 100, 300, 500 can include a hinge panel 107 foldably connected to the base panel 101, a top panel 109 foldably connected to the hinge panel 107, a first top side panel 111*a* foldably connected to the top panel 109, a plurality of first top side flaps 113*a, b* foldably connected to the first top side panel 111*a*, a second top side panel 111*b* foldably connected to the top panel 109 opposite the first top side panel 111*a*, and a plurality of second top side flaps 113*c, d* foldably connected to the second top side panel 111*b*.

An end first base side flap 105*a* and an end first top side flap 113*b* can be formed and separated by a first cut line 117*a* such that the end first base side flap 105*a* and the end first top side flap 113*b* are abutting each other. Similarly, an end second base side flap 105*e* and an end second top side flap 113*d* can be formed and separated by a second cut line 117*b* such that the end second base side flap 105*e* and the end second top side flap 113*d* are abutting each other. Such a configuration can maximize usage of the available material in a given square area while minimizing waste and increasing strength, as well as simplifying manufacturing of the blank and formation of a package from the blank, for example. Increasing stacking strength of packages can allow for a reduction in thickness of the material used for form the blank and an overall material savings.

The plurality of first and second base side flaps 105*a-h* can include two side flaps (e.g., pair 105*a*, 105*b*, pair 105*c*, 105*d*, pair 105*e*, 105*f*, and pair 105*g*, 105*h*) foldably connected to each other on each side of the first and second base side panel 103*a*, 103*b*, respectively, e.g., as shown in FIG. 1A. Any other suitable number of side flaps and/or panels is contemplated herein.

The blank 100, 300, 500 can include a base side panel fold line 119*a, b* between each base side panel 103*a, b* and the base panel 101. The blank 100, 300, 500 can include a hinge panel base fold line 121 between the base panel 101 and the hinge panel 107. Each base side panel fold line 119*a, b* between each base side panel 103*a, b* and the base panel 101 can be perpendicular relative to the hinge panel base fold line 121 between the base panel 101 and the hinge panel 107.

The blank 100, 300, 500 can include a base side flap fold line 123*a, b, c, d* between adjacent base side flaps (e.g., between pair 105*a*, 105*b*, pair 105*c*, 105*d*, pair 105*e*, 105*f*, and pair 105*g*, 105*h*). The blank 100, 300, 500 can include a base side panel flap fold line 125*a, b, c, d* between each base side panel 103*a, b* and each adjacent base side flap 105*b*, 105*c*, 105*f*, 105*g*. Each base side flap fold line 123*a, b, c, d* and each base side panel flap fold line 125*a, b, c, d* can be parallel with the hinge panel base fold line 121, for example, e.g., as shown.

The plurality of first and second top side flaps 113*a, b, c, d* can include one top side flap foldably connected to each side of the first and second top side panel 111*a, b*, respectively (e.g., one top side flap 113*a* connect on a left of panel 111*a* as shown, another single panel 113*b* connected on a right as shown). Any other suitable number of top side flaps is contemplated herein.

The blank 100, 300, 500 can further include a top side panel fold line 127*a, b* between each top side panel 111*a, b*, and the top panel 109. The blank 100, 300, 500 can also include a hinge panel top fold line 129 between the top panel 109 and the hinge panel 107. Each top side panel fold line 127*a, b* between each top side panel 111*a, b* and the top panel 109 can be perpendicular relative to the hinge panel top fold line 129 between the top panel 109 and the hinge panel 107. As shown the hinge fold lines 121, 129 can be parallel, and the hinge panel 107 can be configured to form a side of a package.

The blank 100, 300, 500 can include a top side panel flap fold line 131*a, b, c, d* between each top side panel 111*a, b* and each top side flap 113*a, b, c, d*. Each top side panel flap fold line 131*a, b, c, d* can be parallel with the hinge panel top fold line 129. Each top side panel fold line 127*a, b* can be collinear with a respective base side panel fold line 119*a, b* (e.g., fold lines 127*a* and 119*a* can be collinear, and fold lines 127*b* and 119*b* can be collinear).

As shown, the base panel 101 and the top panel 109 can be the same shape and dimensions. In certain embodiments, the base panel 101 and the top panel 109 can be octagonal (e.g., a regular octagon or an irregular octagon as shown). In certain embodiments, the hinge panel 107, all side panels 103*a, b*, 111*a, b*, and all side flaps 105*a-h*, 113*a, b, c, d* can be rectangular. Any other suitable shape for one or more panels/flaps are contemplated herein.

The hinge panel 107 and each side panel 103*a, b*, 111*a, b* can have about the same length dimension extending away from the base panel 101 and/or the top panel 109, respectively (e.g., to have the same height when formed). Some or all of the side flaps 105*a-h*, 113*a-d* can have about the same shape and dimensions as other side flaps and/or side panels 103*a, b*, 111*a, b*. In certain embodiments, e.g., as shown, the end base side flaps 105*a*, 105*e* and/or 105*d*, 105*h* have a slightly smaller length dimension extending away from the base panel 101, e.g., to accommodate a folding of a wrap around panel (e.g., folding top panel 109).

Figure 2A:
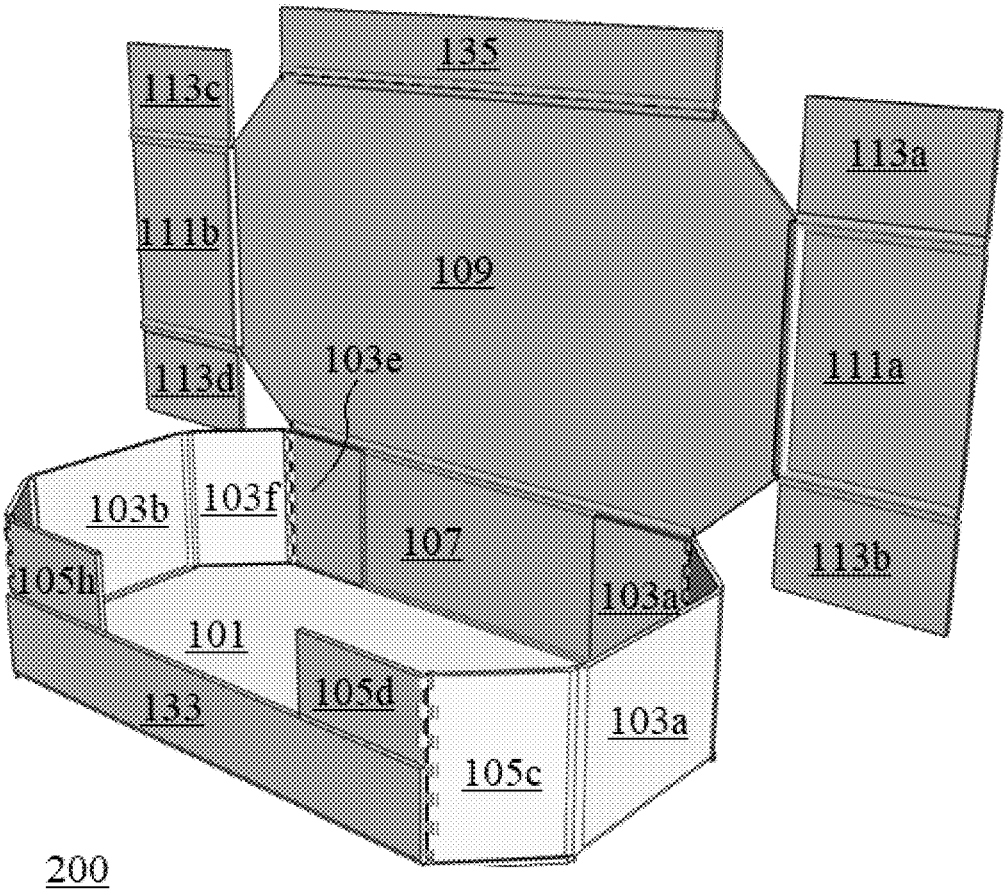
FIG. 2A is a perspective view of a package formed from the blank of FIG. 1, shown having the top in an open position.
Figure 2B:
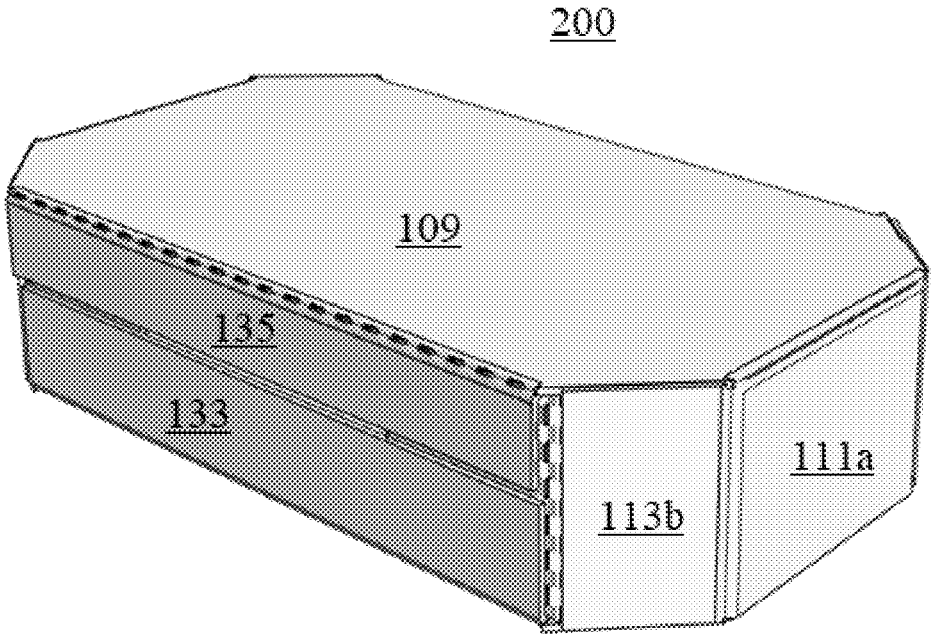
FIG. 2B is a perspective view of the package of FIG. 2A, shown having the top in closed position.
Figure 2C:
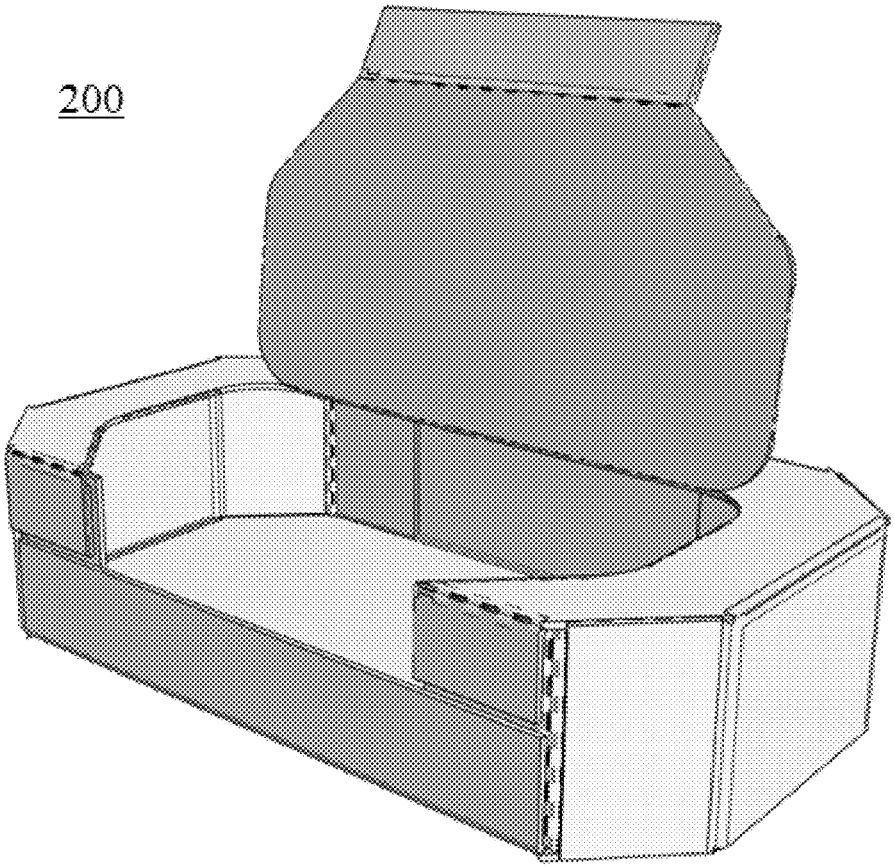
FIG. 2C is a perspective view of the package of FIG. 2A, shown having a tear away portion in the top in a torn away position.

The blank 100, 300, 500 can further include one or more front side panels 133, 135 foldably connected to the base panel 101 and/or the top panel 109 opposite the hinge panel 107. In certain embodiments, as shown in the embodiment of FIGS. 1-2C, the one or more front side panels 133, 135 can include a top front panel 135 foldably connected to the top panel 109, and a base front panel 133 foldably connected to the base panel 101. As shown, in certain embodiments, the top front panel 135 and base front panel 133 can be dimensioned to have a combined length dimension extending away from the base panel 101 and the top panel 109 about equal to or less than the hinge panel 107. (e.g., such that the panels meet or have a gap therebetween when wrapped around the side flaps 105*d*, 105*h* as shown in FIG. 1). This embodiment may require the least amount of material to make due to a possible gap, e.g., for viewing, than other embodiments below.

Figure 3:
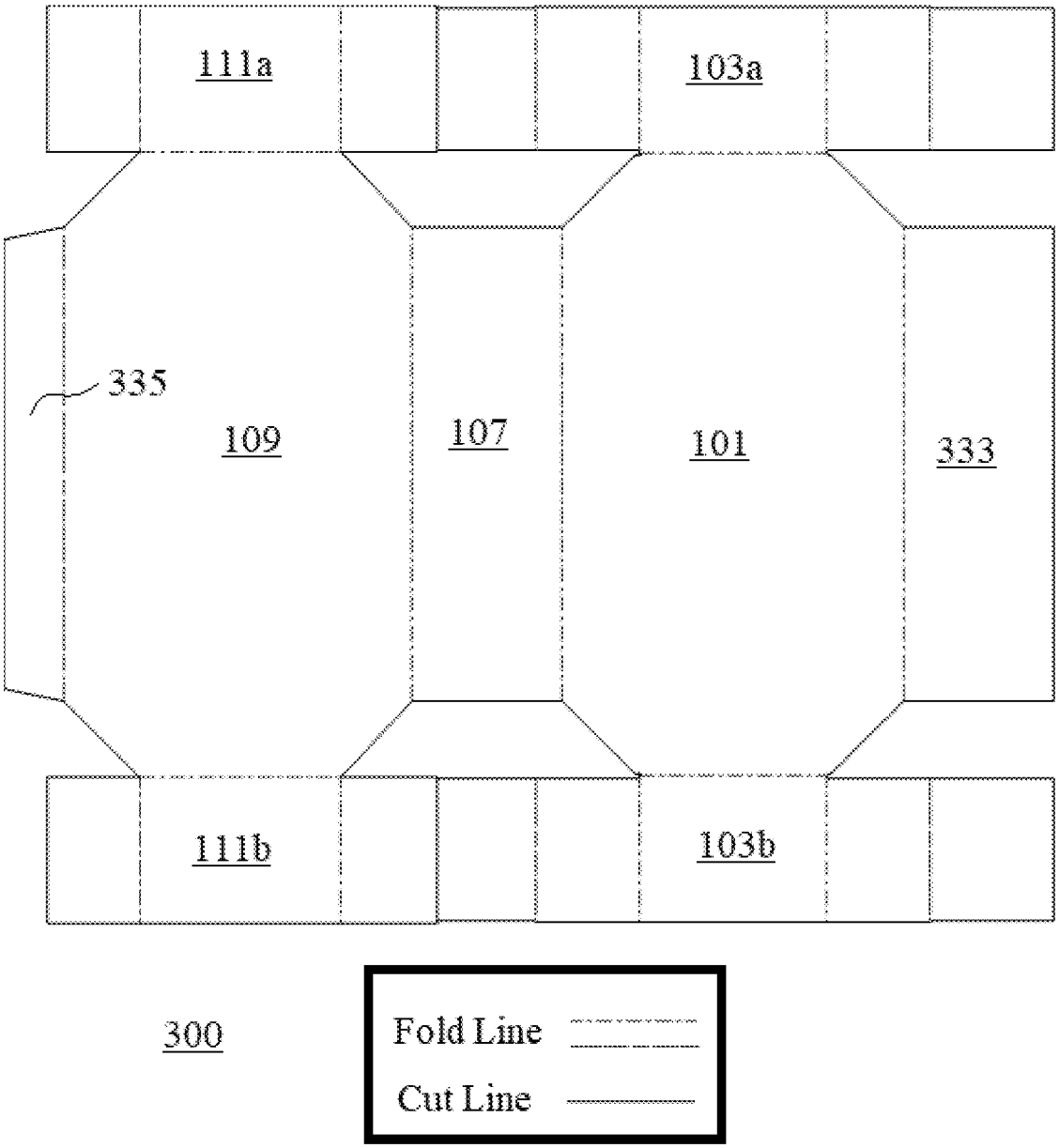
FIG. 3 is a schematic view of an embodiment of a blank accordance with this disclosure.
Figure 4A:
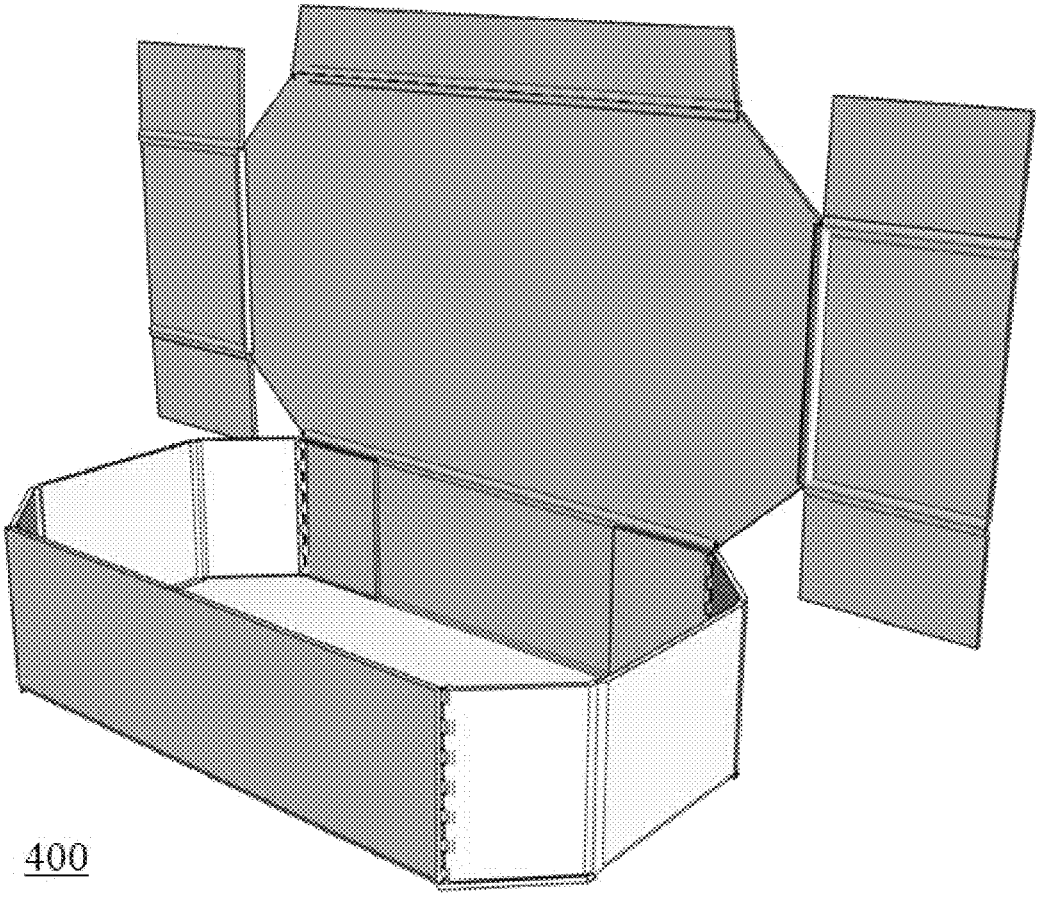
FIG. 4A is a perspective view of a package formed from the blank of FIG. 3, shown having the top in an open position.
Figure 4B:
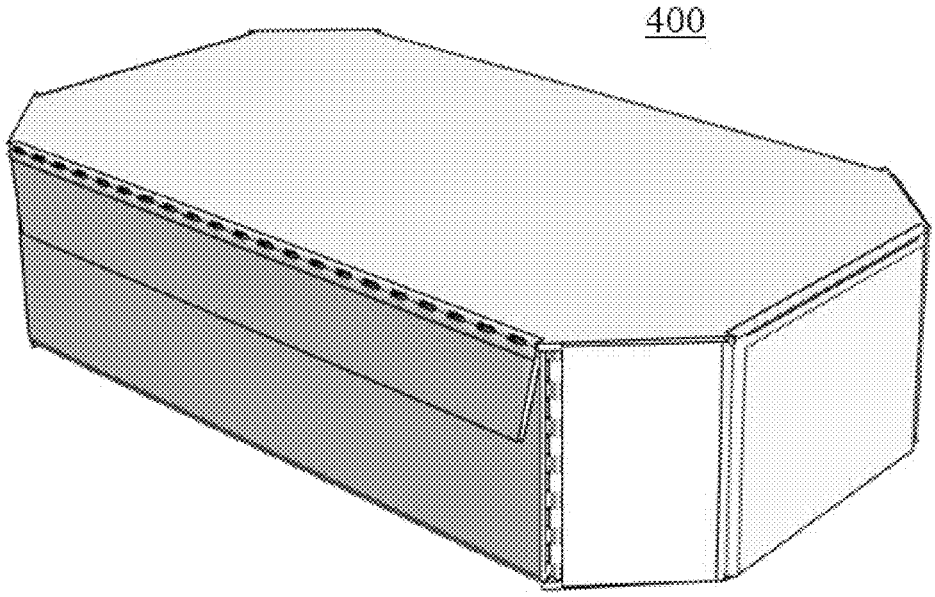
FIG. 4B is a perspective view of the package of FIG. 4A, shown having the top in closed position.

In certain embodiments, referring to the embodiment of FIGS. 3-4C, the one or more front side panels 333, 335 can include a top front panel 335 foldably connected to the top panel 109, and a base front panel 333 foldably connected to the base panel 101. The base front panel 333 can include a length dimension extending away from the base panel 101 about equal to the hinge panel 107.

Figure 5:
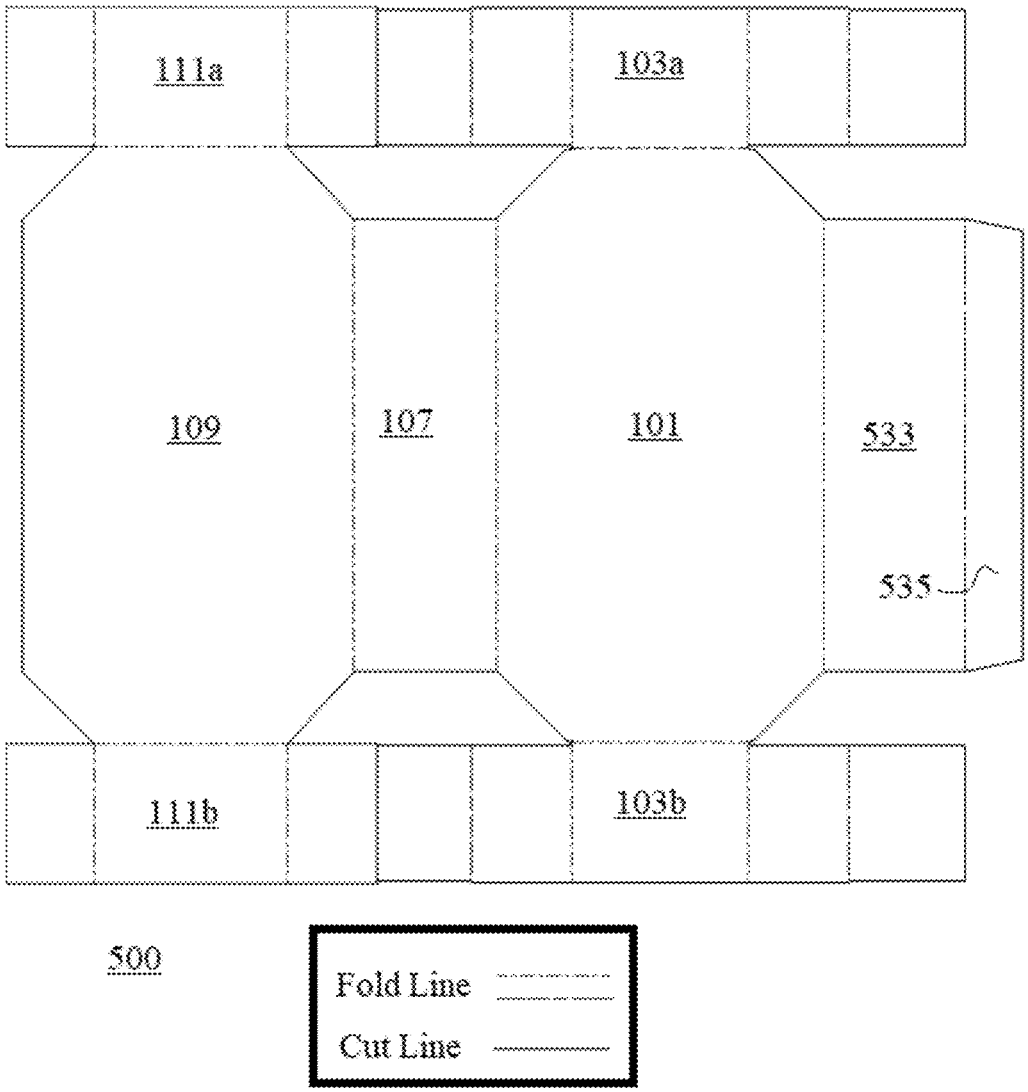
FIG. 5 is a schematic view of an embodiment of a blank accordance with this disclosure.
Figure 6A:
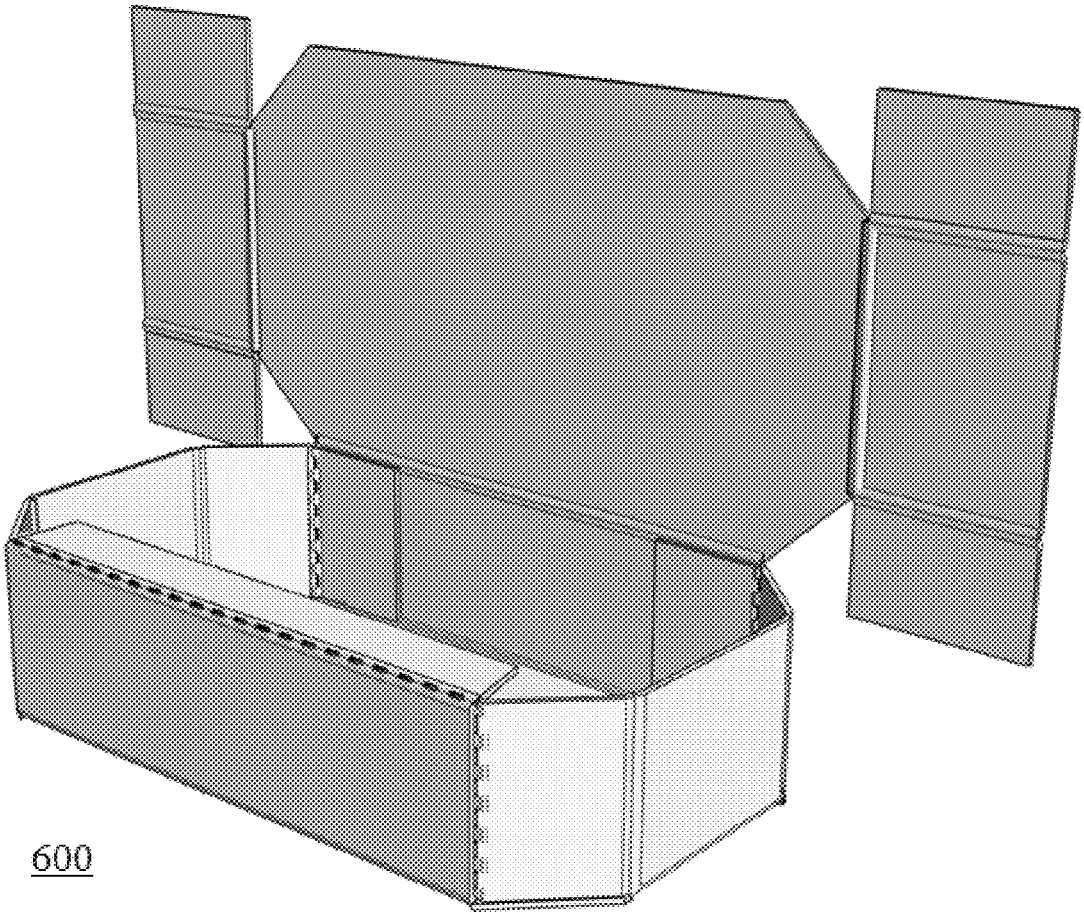
FIG. 6A is a perspective view of a package formed from the blank of FIG. 5, shown having the top in an open position.
Figure 6B:
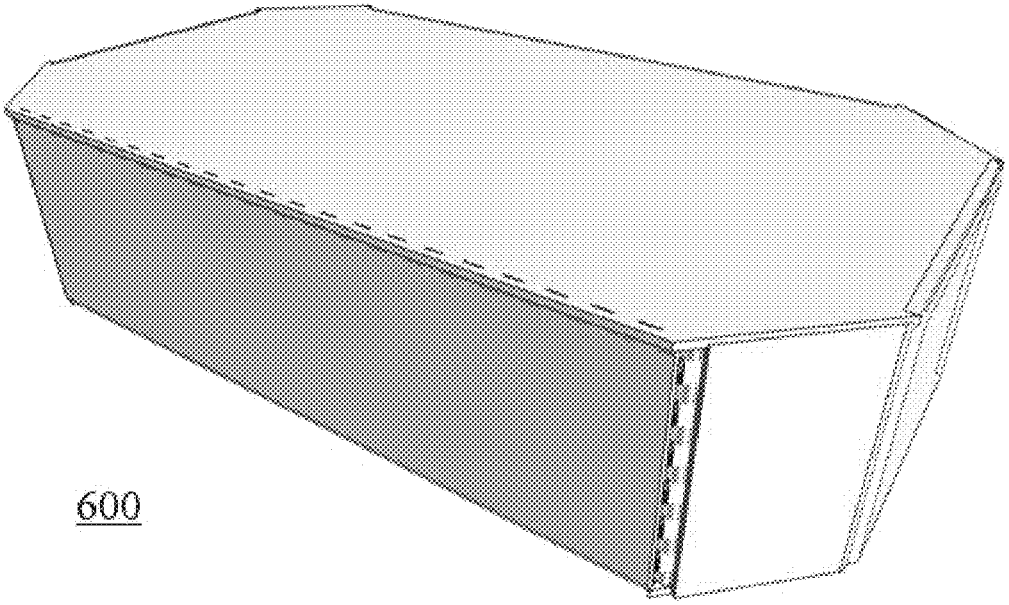
FIG. 6B is a perspective view of the package of FIG. 6A, shown having the top in closed position.
Figure 6C:
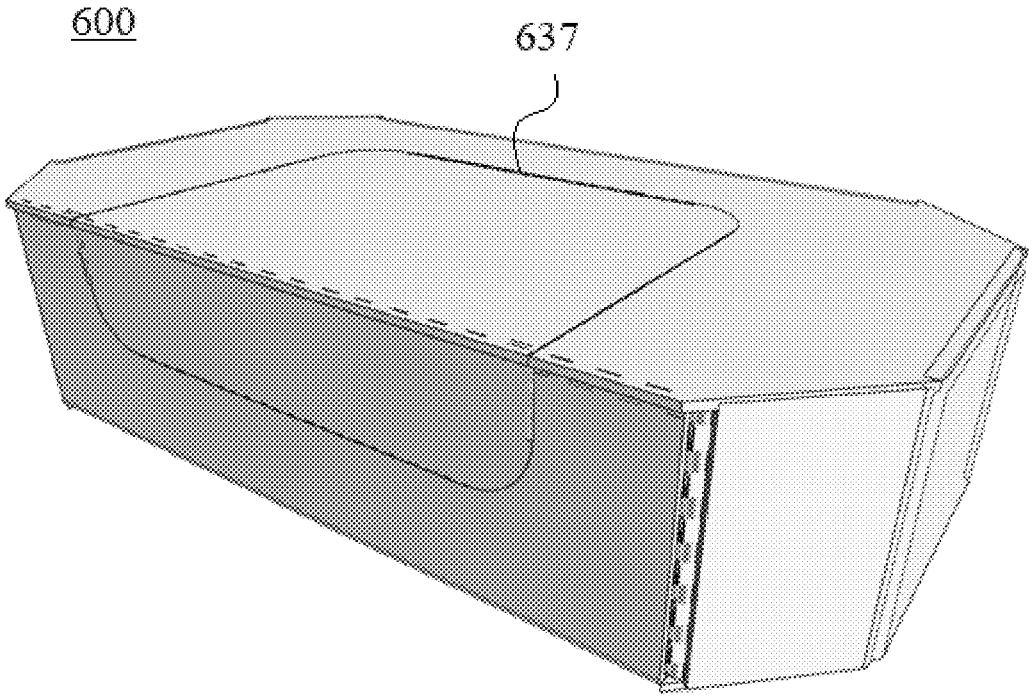
FIG. 6C is a perspective view of the package of FIG. 2A, shown having a tear away portion in the top in an untorn position.

In certain embodiments, referring to the embodiment of FIGS. 5-6C, the one or more front side panels 533, 535 can include a base front panel 533 foldably connected to the base panel 101 and an attachment panel foldably 535 connected to the base front panel 533 opposite the base panel 101. The base front panel 533 can include a length dimension extending away from the base panel 101 about equal to the hinge panel 107, e.g., as shown.

In certain embodiments, e.g., as shown in FIGS. 2C and 6C, the blank 100, 300, 500 can include a tearaway line 637 defined in the top panel 109 and/or the top front panel and/or the base front panel (e.g., a weakened line such as a perforated line). Any other suitable additional features, fold line, cut lines, and/or weakened lines are contemplated herein.

In accordance with at least one aspect of this disclosure, referring to FIGS. 2A-2C, 4A-4B, and 6A-6C, a package, e.g., 200, 400, 600 can be formed from any suitable embodiment of a blank disclosed herein, e.g., 100, 300, 500 as described above. Any suitable method of forming a package and holding the shape, e.g., gluing, mechanically attaching, machine forming and adhering, is contemplated herein. In certain embodiments, a full overlay (FOL) package (e.g., formable from certain embodiments of a blank disclosed herein) can include an octagonal shaped base. The FOL package can be formed from a single blank and can have a total of 12 or more weight bearing corners (e.g., formed by both base and top side flap fold lines, for example). In certain embodiments, the number of weight bearing corners can be 12, 14, or 16. Any other suitable number is contemplated herein.

In certain embodiments, e.g., as shown in certain embodiments such as that of FIGS. 25-28B), the package can include a six sided top panel and other panels configured to cover the octagaonal shaped base such that a handle panel creates a space between a side of the octagonal shaped base and the handle panel to create a finger space for inserting fingers into a handle hole. Any other suitable additional features are contemplated herein. In accordance with at least one aspect of this disclosure, a blank can be configured to form any suitable embodiment of a package as disclosed herein, e.g., as described above.

Embodiments can include non-rectangular single lid FOL tray wraps with reinforcing corner elements. Embodiments can include a footprint shape and minor flap arrangement that can have advantages with rounded products, resulting in a tighter fitting pack and eliminating open corners, and reducing the potential for stretch wrap deformation. Embodiments can maximize the stacking strength of the carton by offering more vertical corner structures, many are larger than 90 degrees and result in a non-traditional, non rectangular footprint. As the available material that provides the stacking strength come out material limited in part by the carton's depth dimension, shallower traditional packages have compromised combinations of inner and outer flaps. In some cases a portion of the outer corner flaps have been reduced to achieve a specific shape or as a strategy to limit the square footage of the overall blank. Certain embodiments having octagonal or angular shapes can provide improved stacking strength through increased, laminated corner structures, further bolstered by FOL end panels having vertical corrugations. The octagonal footprint can also work well with shallower package sizes. For example, certain embodiments can be less than 10 inches deep (e.g., 3-5 inch deep packages), which would correspond to the length of the hinge panel and other matching length panels/flaps.

The embodiments shown in FIGS. 1-6C include an octagonal footprint with two panel inner minor flaps at each of the internal corners of the carton. There are four non-90 degree exterior corners connected to the single top lid and these are folded in an overlay position with the angular inner corners and has advantages in shallower trays without excessively growing the blank size and square footage. This structure results in 12 non-90 degree corners. A larger (longer) outside glue lap can be achievable compared to a 16 corner design, for example. Such embodiments may also open up more product visibility in a display ready pack formats.

Figure 7:
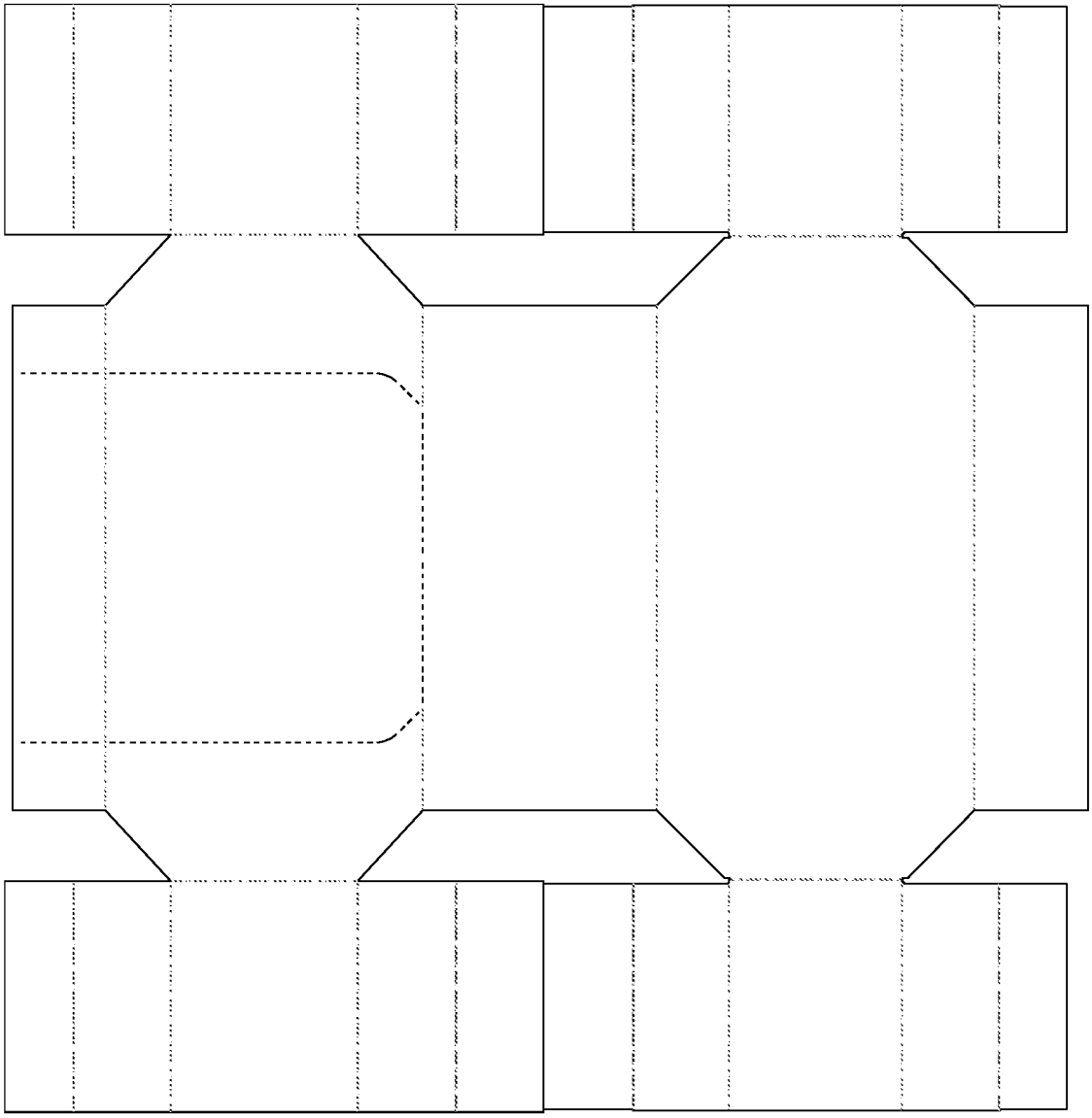
FIG. 7 is a schematic view of an embodiment of a blank accordance with this disclosure.
Figure 8A:
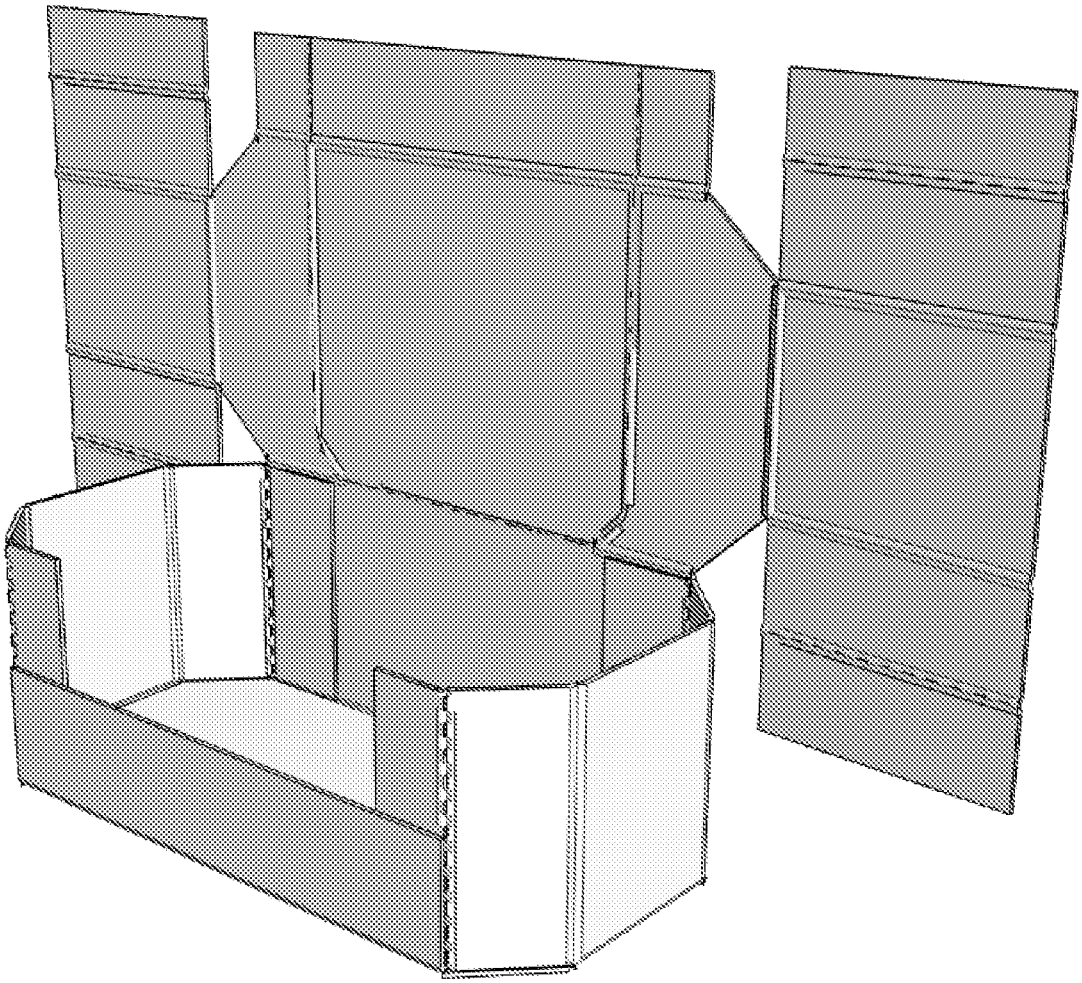
FIGS. 8A, 8B, 8C, 8D, and 8E show perspective views of a package formed from the blank of FIG. 7, shown in various positions.
Figure 8B:
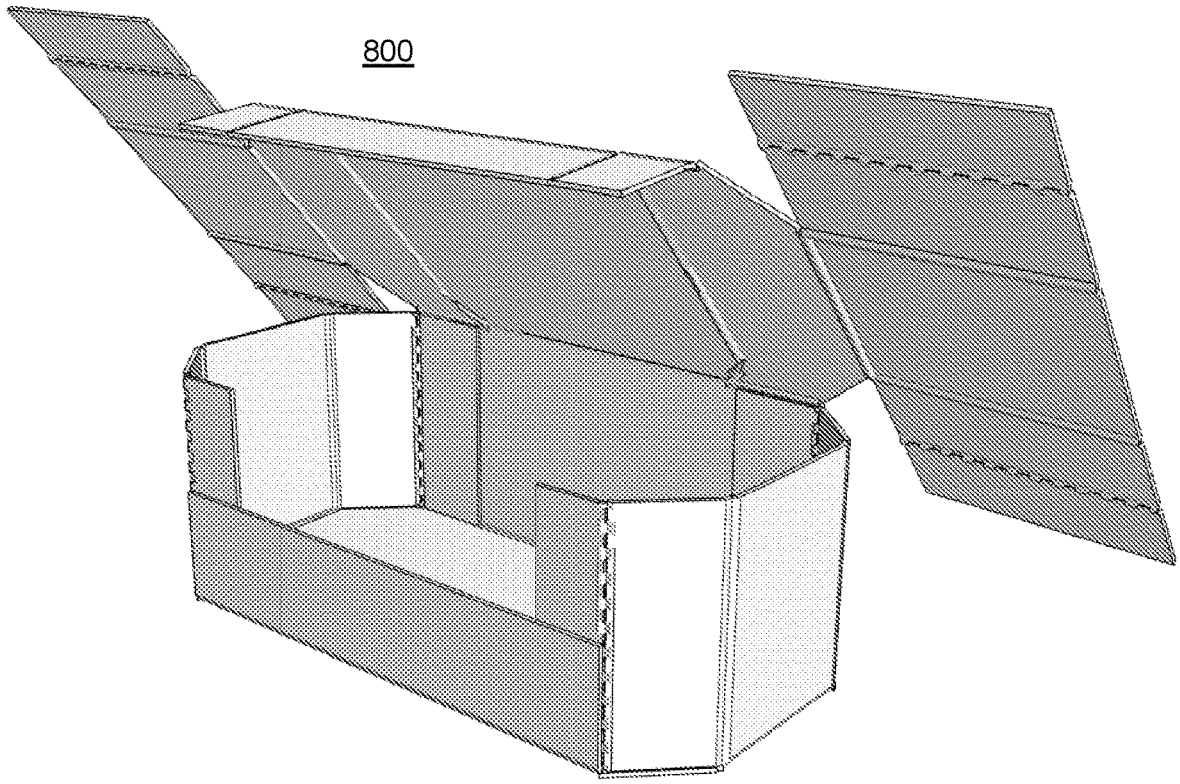
Figure 8C:
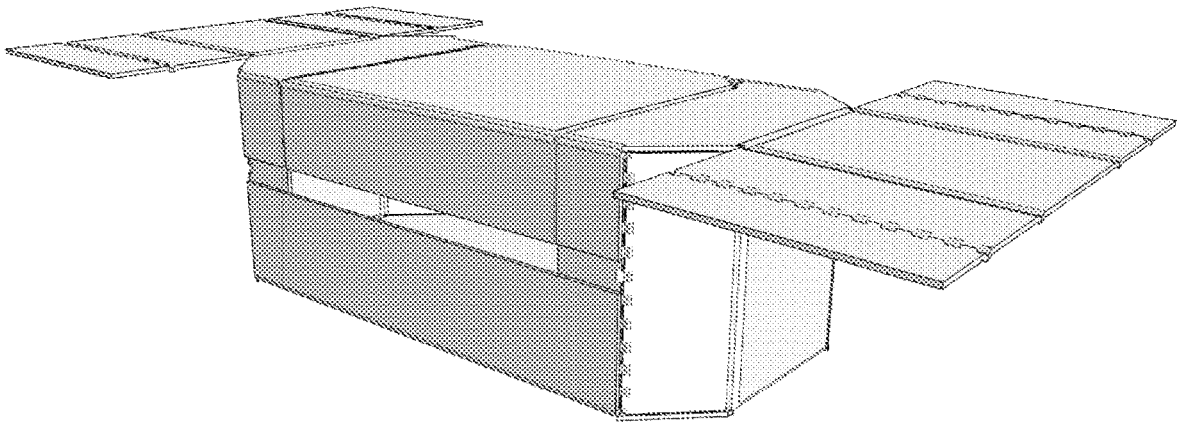
Figure 8D:
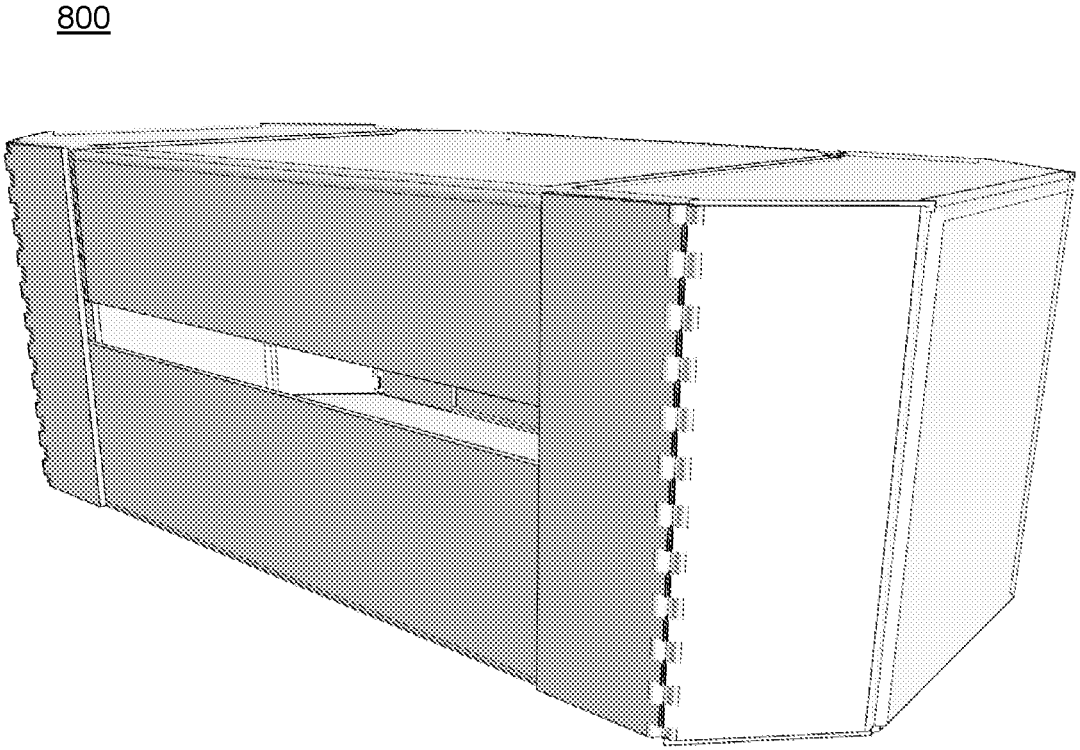
Figure 8E:
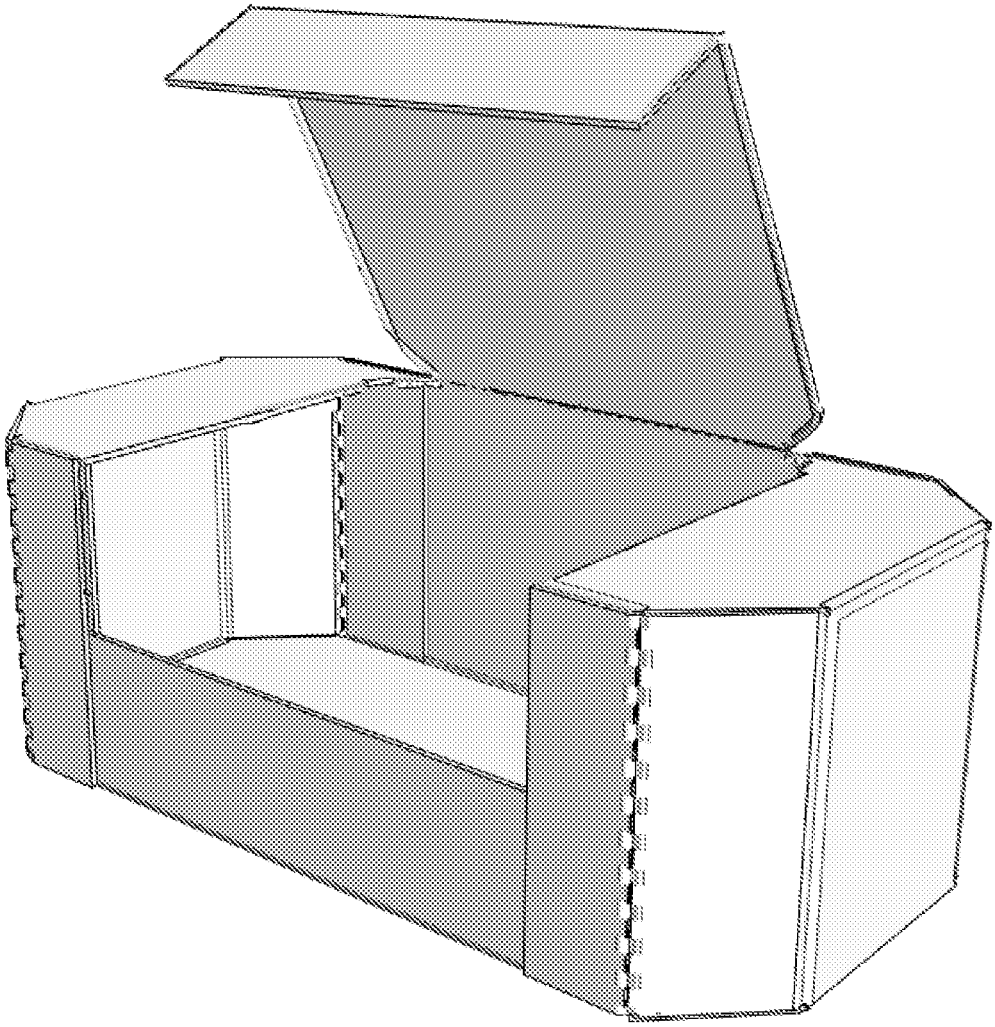
Figure 9:
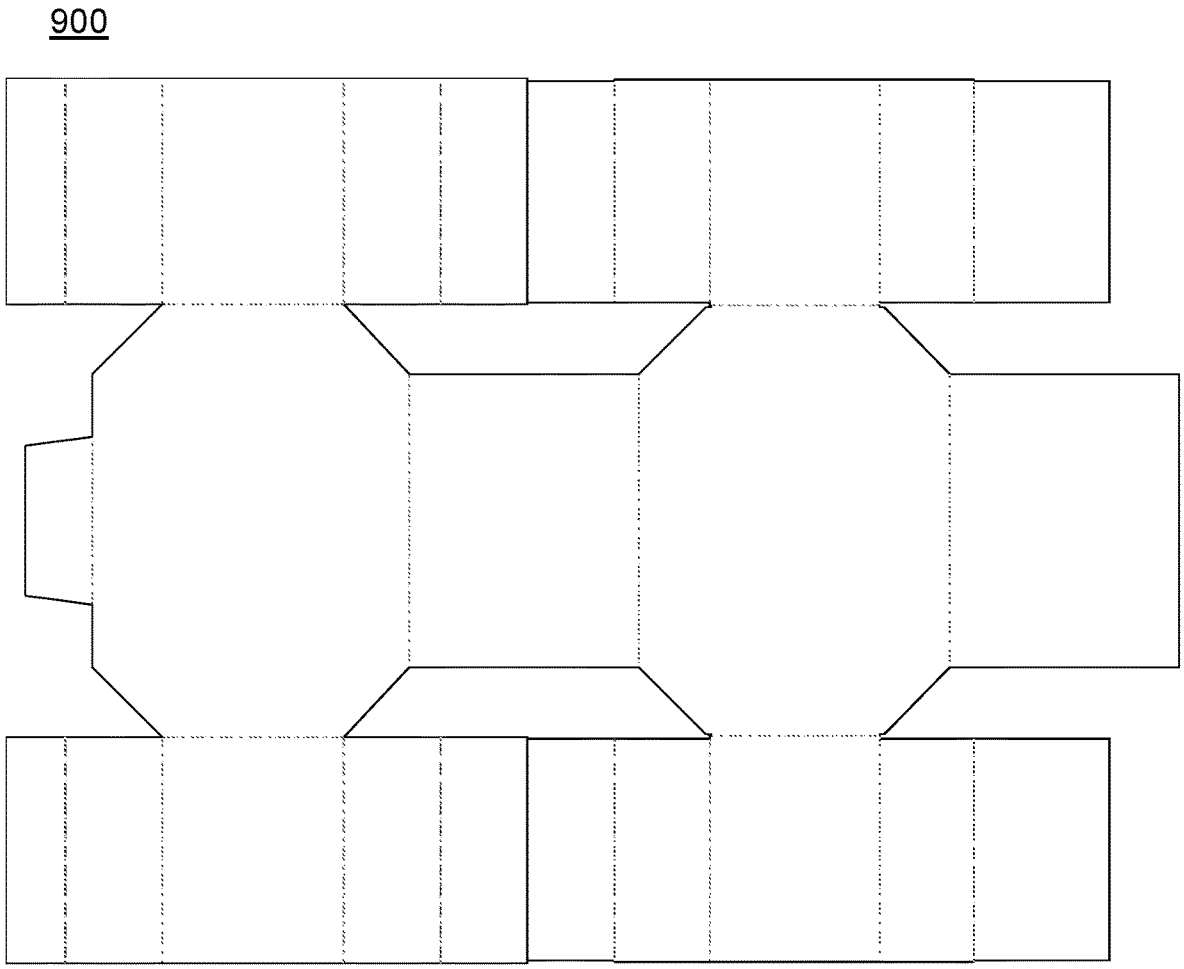
FIG. 9 is a schematic view of an embodiment of a blank accordance with this disclosure.
Figure 10A:
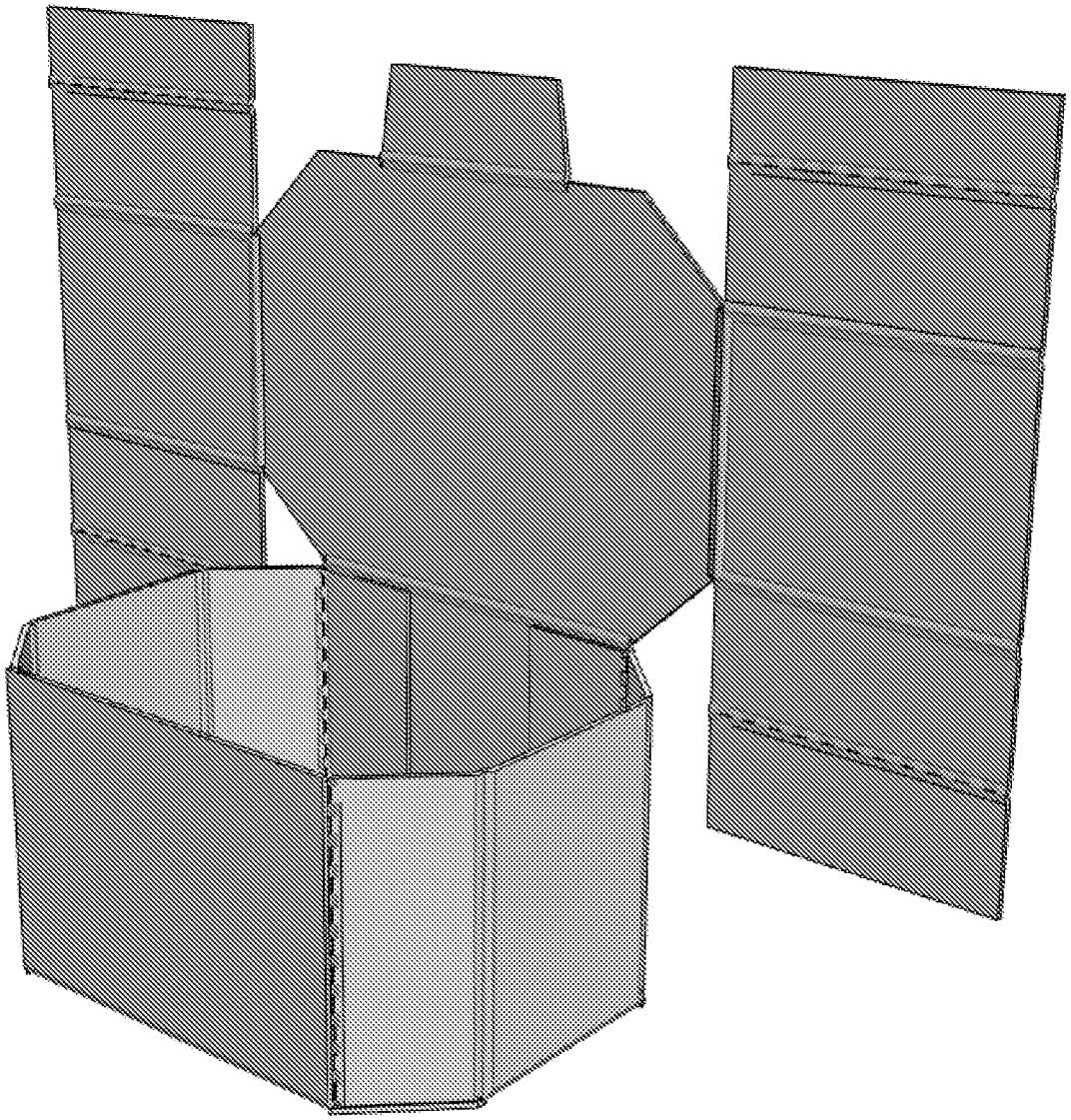
FIGS. 10A and 10B show perspective views of a package formed from the blank of FIG. 9, shown in an open and closed position, respectively.
Figure 10B:
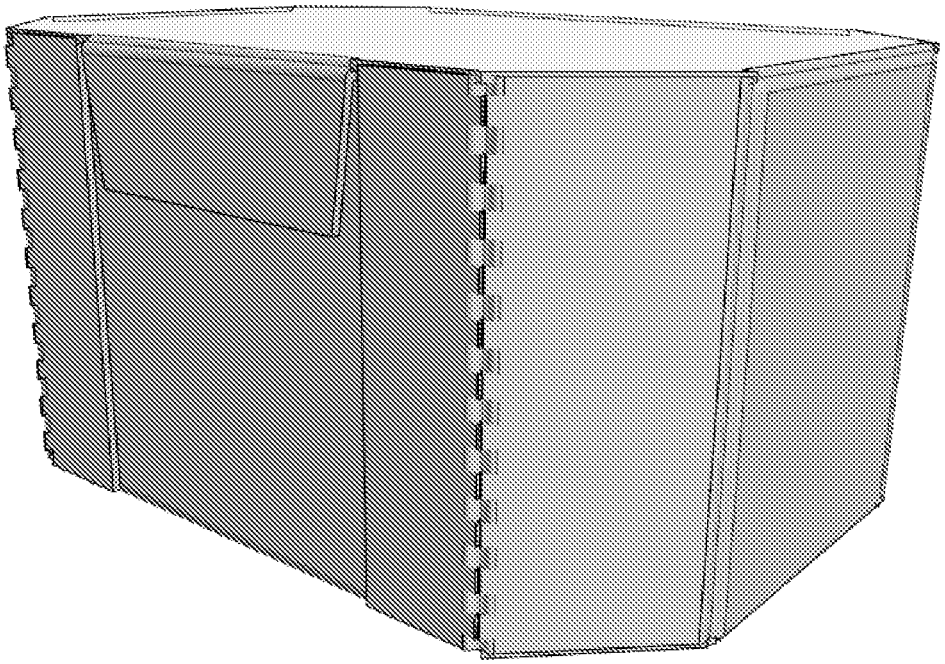
Figure 11:
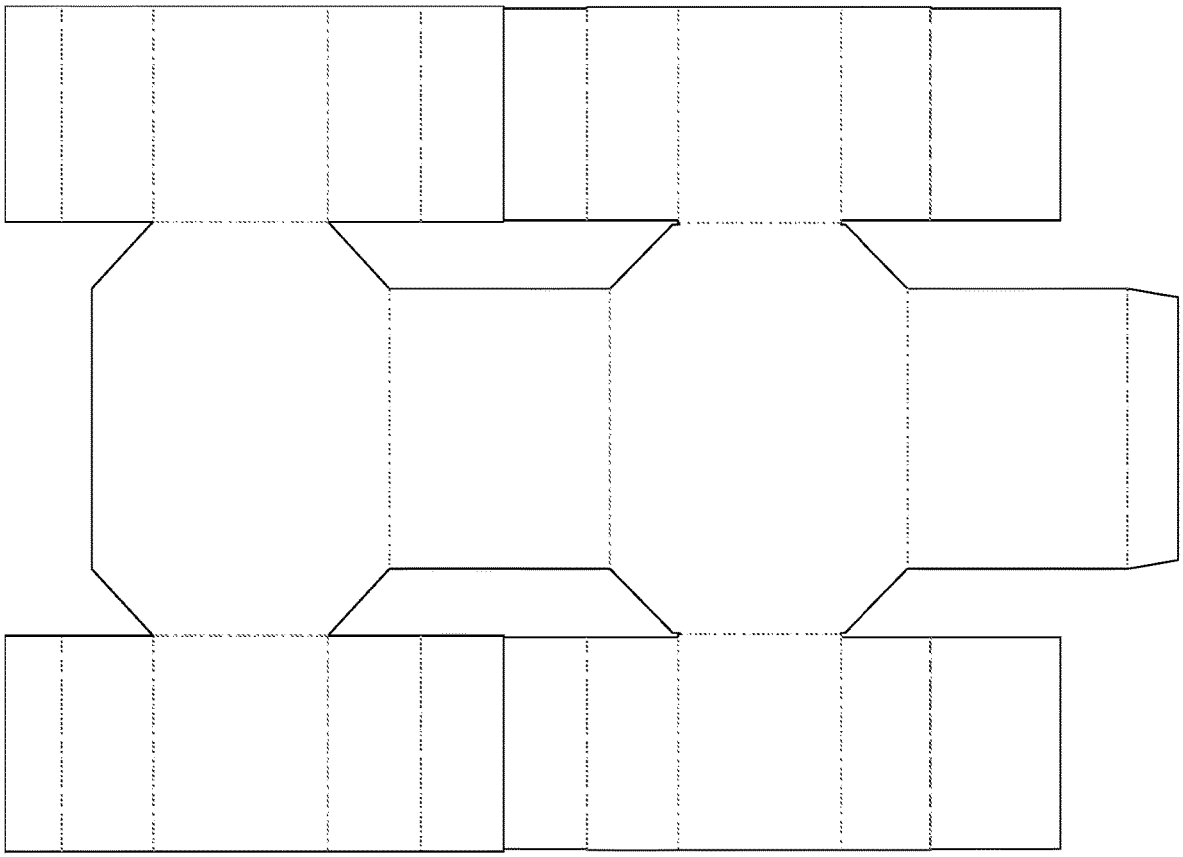
FIG. 11 is a schematic view of an embodiment of a blank accordance with this disclosure.
Figure 12A:
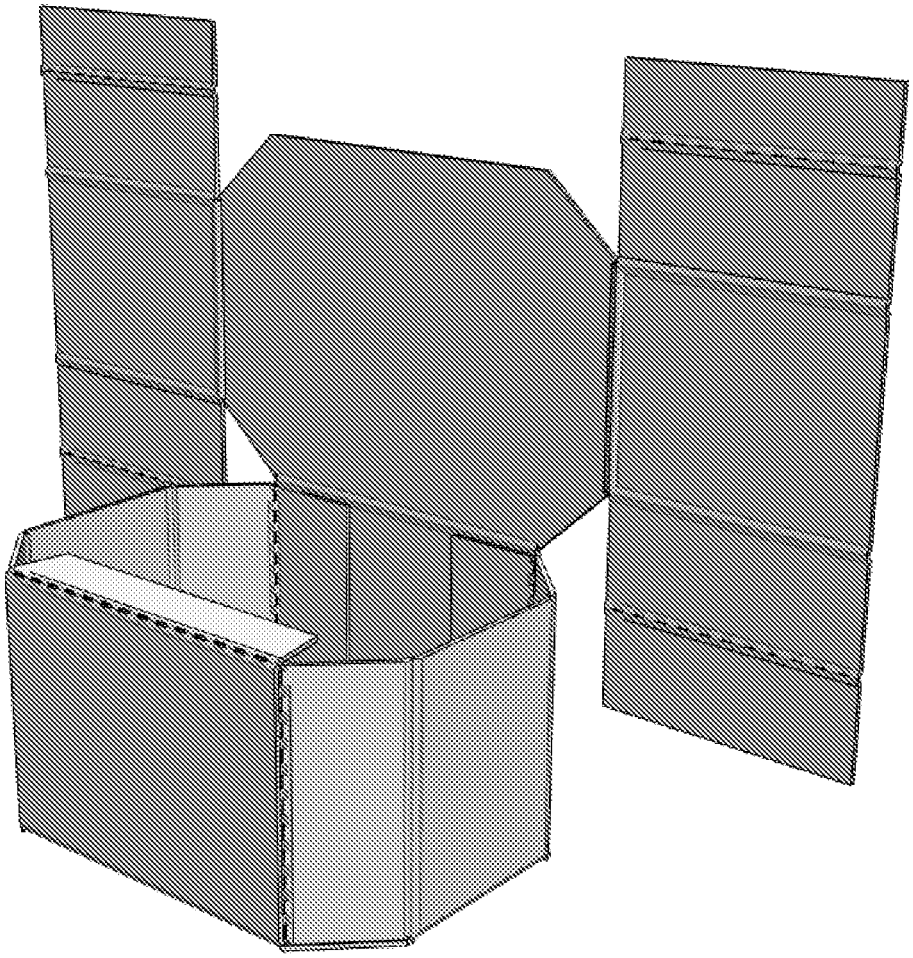
FIGS. 12A and 12B show perspective views of a package formed from the blank of FIG. 11, shown in an open and closed position, respectively.
Figure 12B:
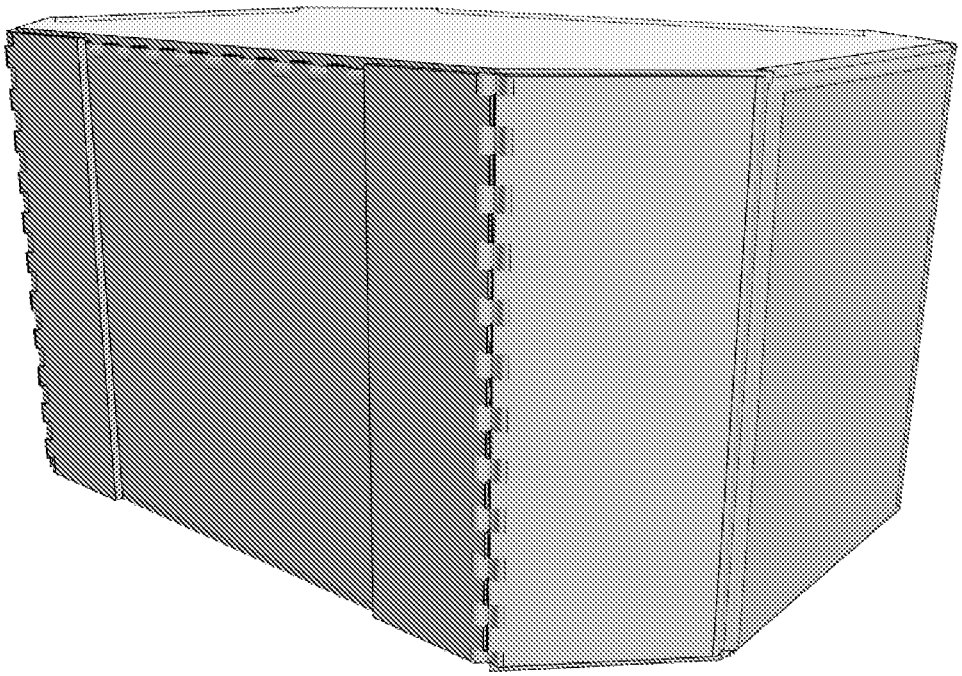

FIG. 7 is a schematic view of an embodiment of a blank 700 accordance with this disclosure. FIGS. 8A, 8B, 8C, 8D, and 8E show perspective views of a package 800 formed from the blank 700 of FIG. 7, shown in various positions. FIG. 9 is a schematic view of an embodiment of a blank 900 accordance with this disclosure. FIGS. 10A and 10B show perspective views of a package 1000 formed from the blank 900 of FIG. 9, shown in an open and closed position, respectively. FIG. 11 is a schematic view of an embodiment of a blank 1100 accordance with this disclosure. FIGS. 12A and 12B show perspective views of a package 1200 formed from the blank 1100 of FIG. 11, shown in an open and closed position, respectively.

Referring to the embodiments of FIGS. 7-12B, embodiments can provide an octagonal inside and outside FOL Tray wrap which provides 16 non-90 degree vertical corners for exceptional stacking strength. Each of the inner and outer flap configurations can have two linear panels attached to an end panel and located in an FOL overlay, being adhered to the overlapping panels. Such embodiments can be accomplished with a full depth front panel with an outer front glue lap, an interior top glue lap, or a partial depth front flap corresponding with a partial depth base flap. While the partial front option can be beneficial for Retail Ready Display applications, any suitable embodiments can include display ready features. In these embodiments show, the outer FOL overlapping panels and attached minor flaps create the strength with the second or outermost minor flap paralleling the length of the tray.

Figure 13:
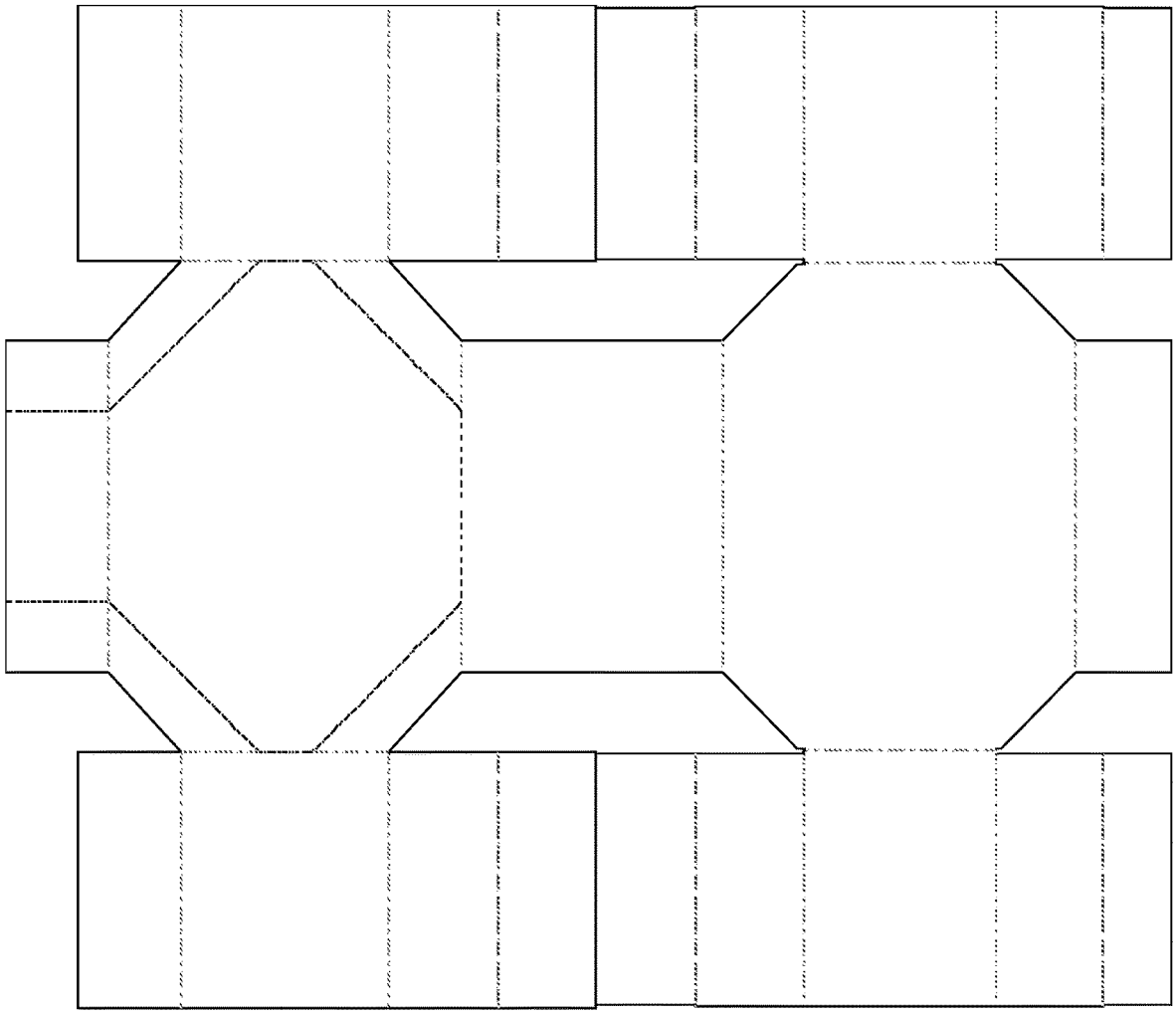
FIG. 13 is a schematic view of an embodiment of a blank accordance with this disclosure.
Figure 14A:
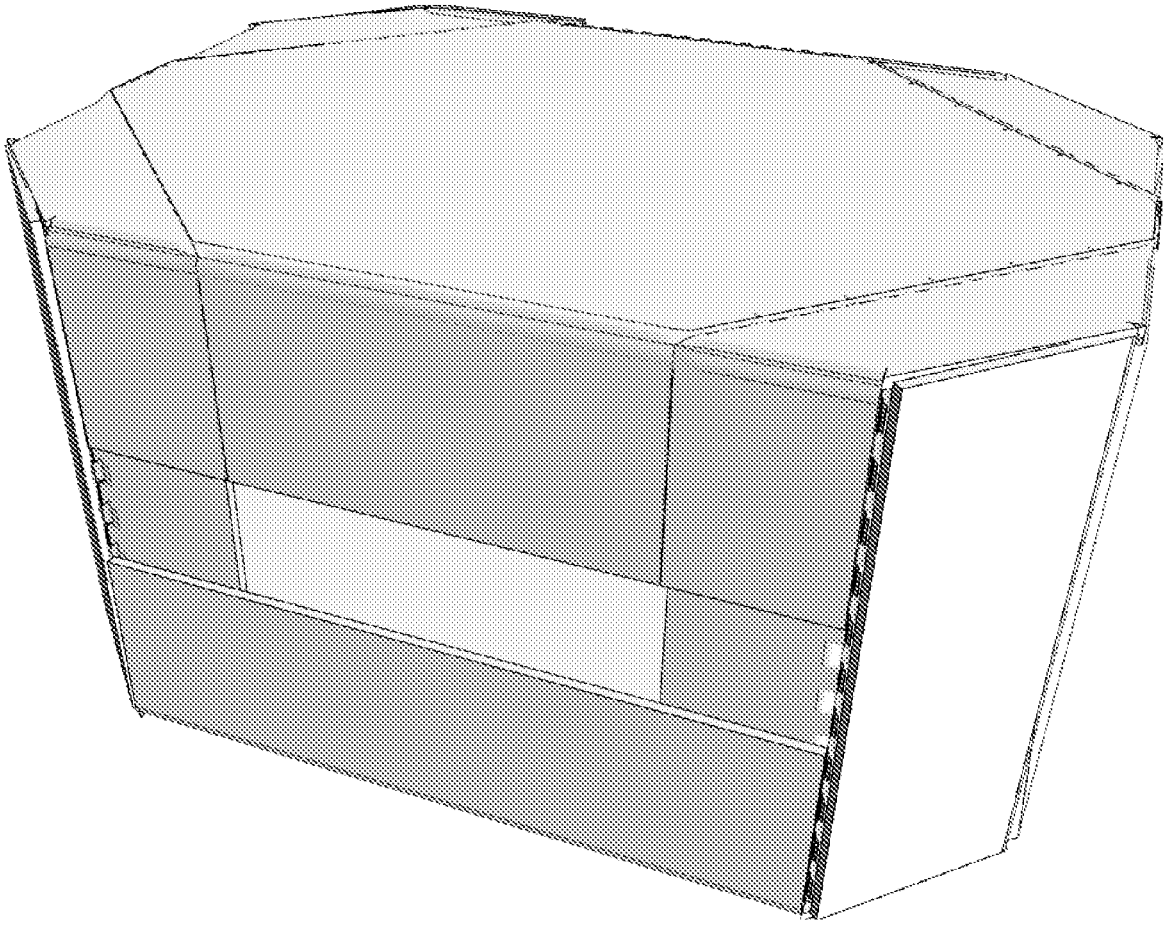
FIGS. 14A and 14B show perspective views of a package formed from the blank of FIG. 13, shown in a closed and torn open position, respectively.
Figure 14B:
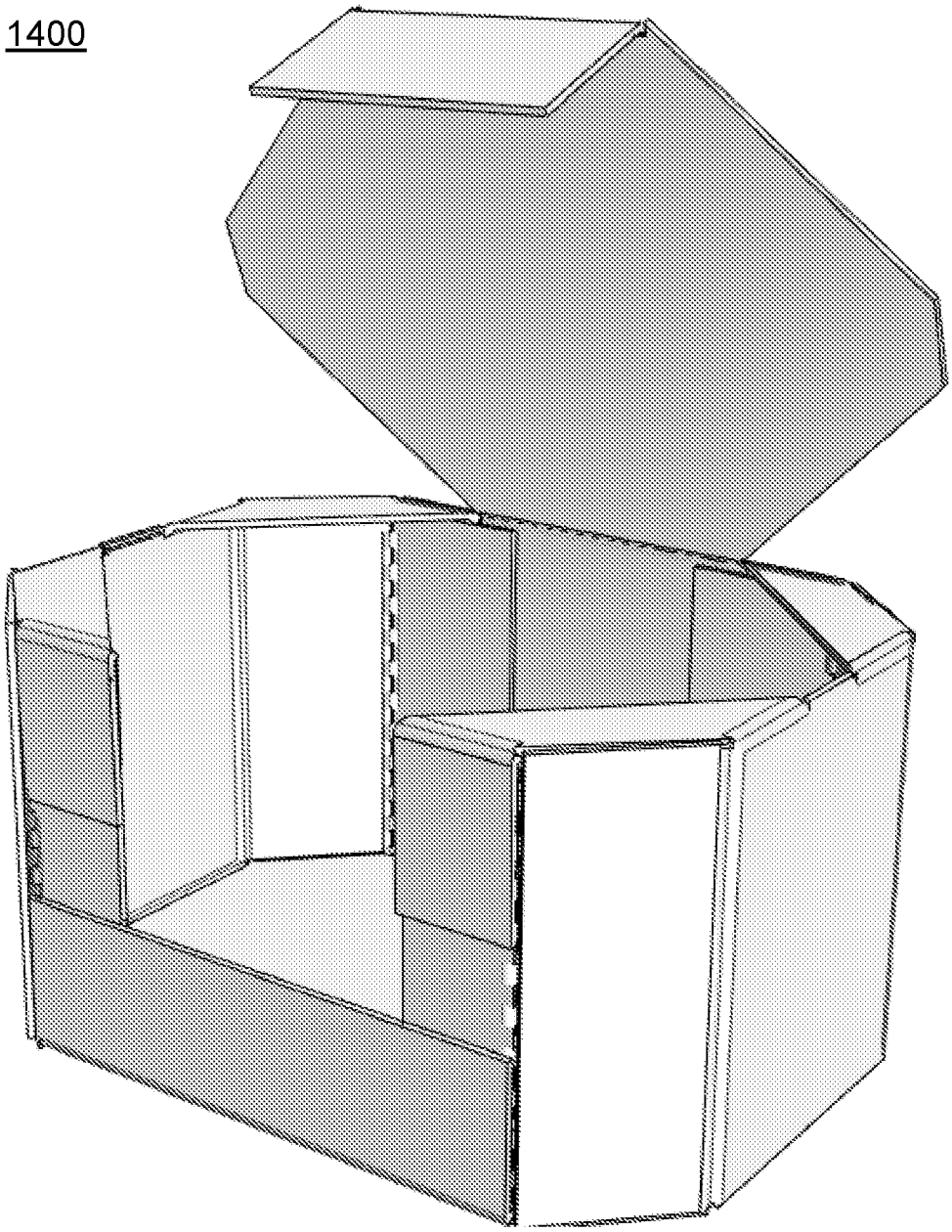
Figure 15:
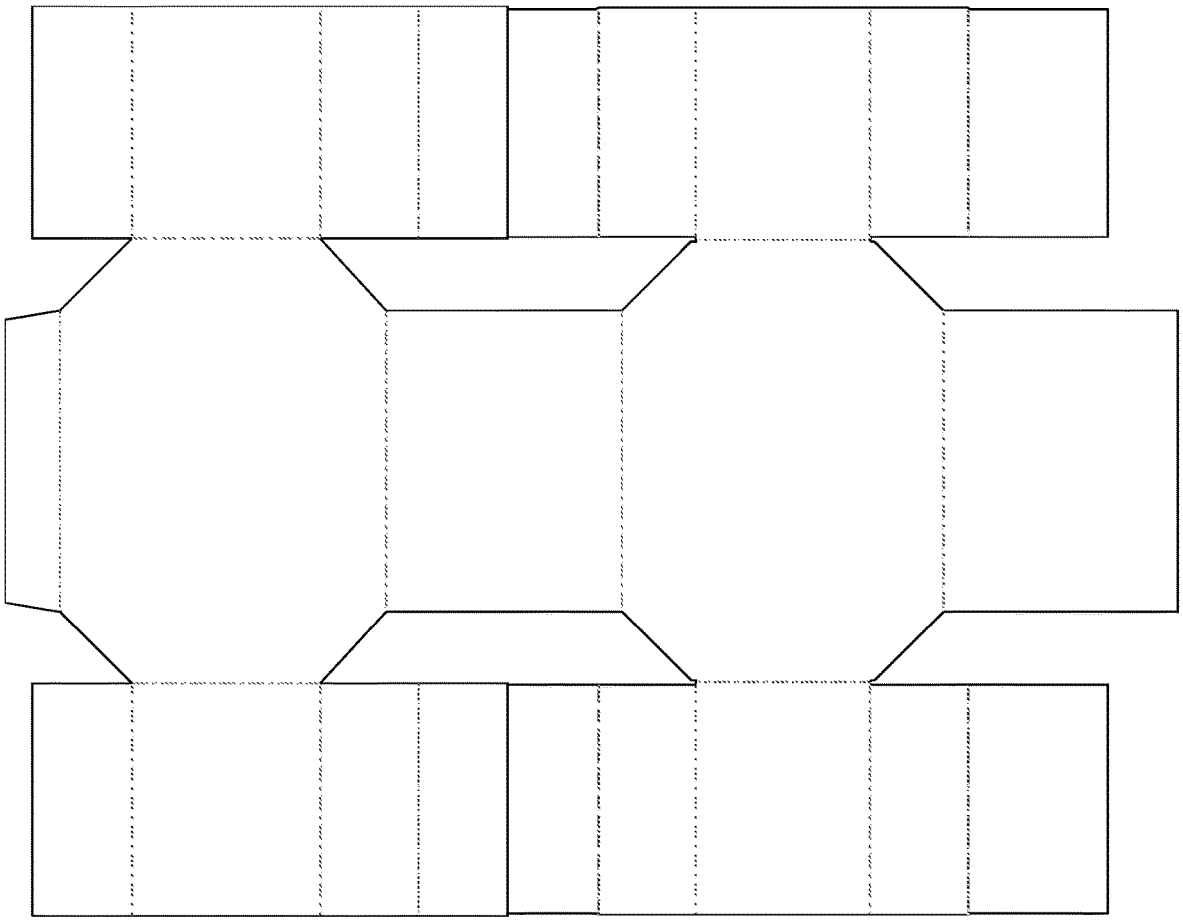
FIG. 15 is a schematic view of an embodiment of a blank accordance with this disclosure.
Figure 16A:
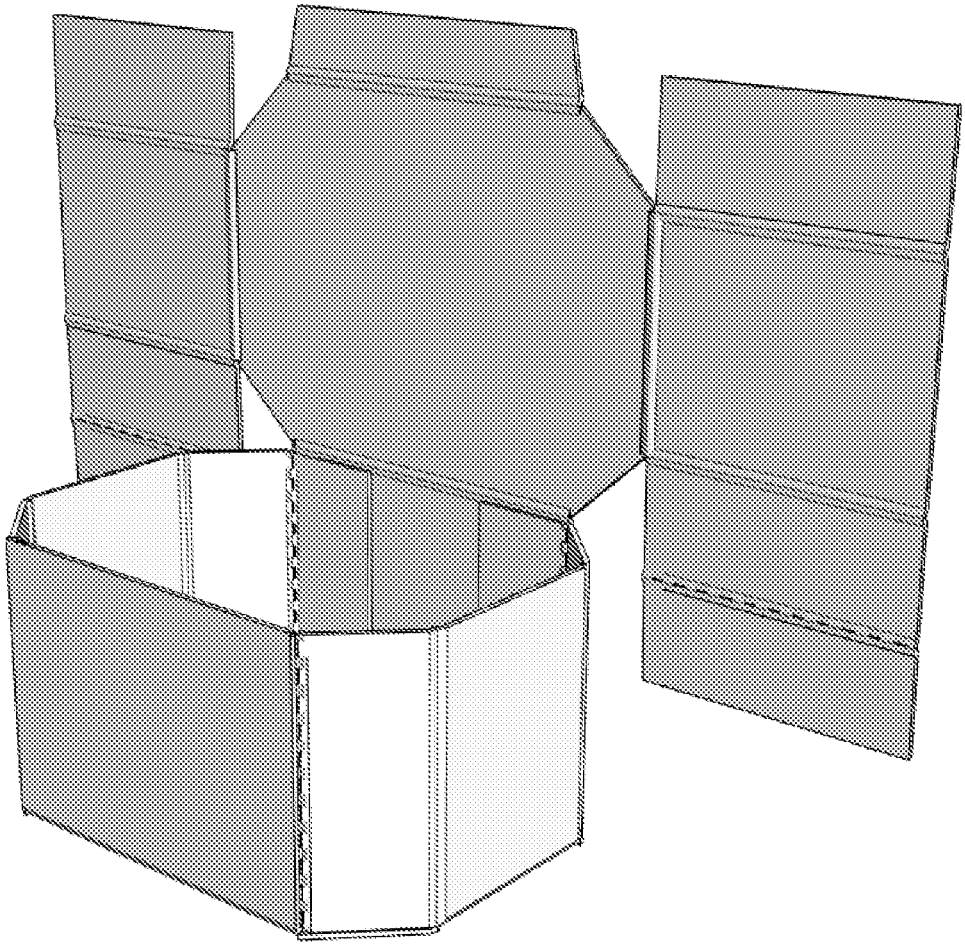
FIGS. 16A and 16B show perspective views of a package formed from the blank of FIG. 15, shown in an open and closed position, respectively.
Figure 16B:
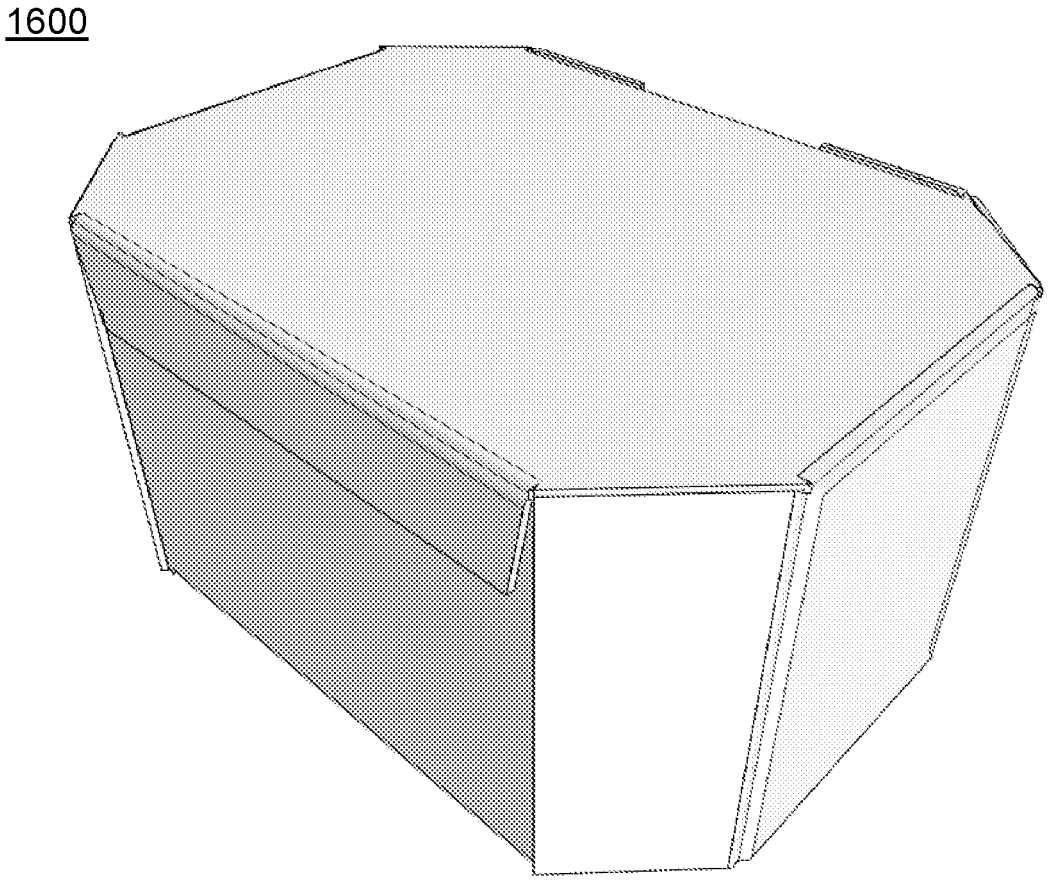
Figure 17:
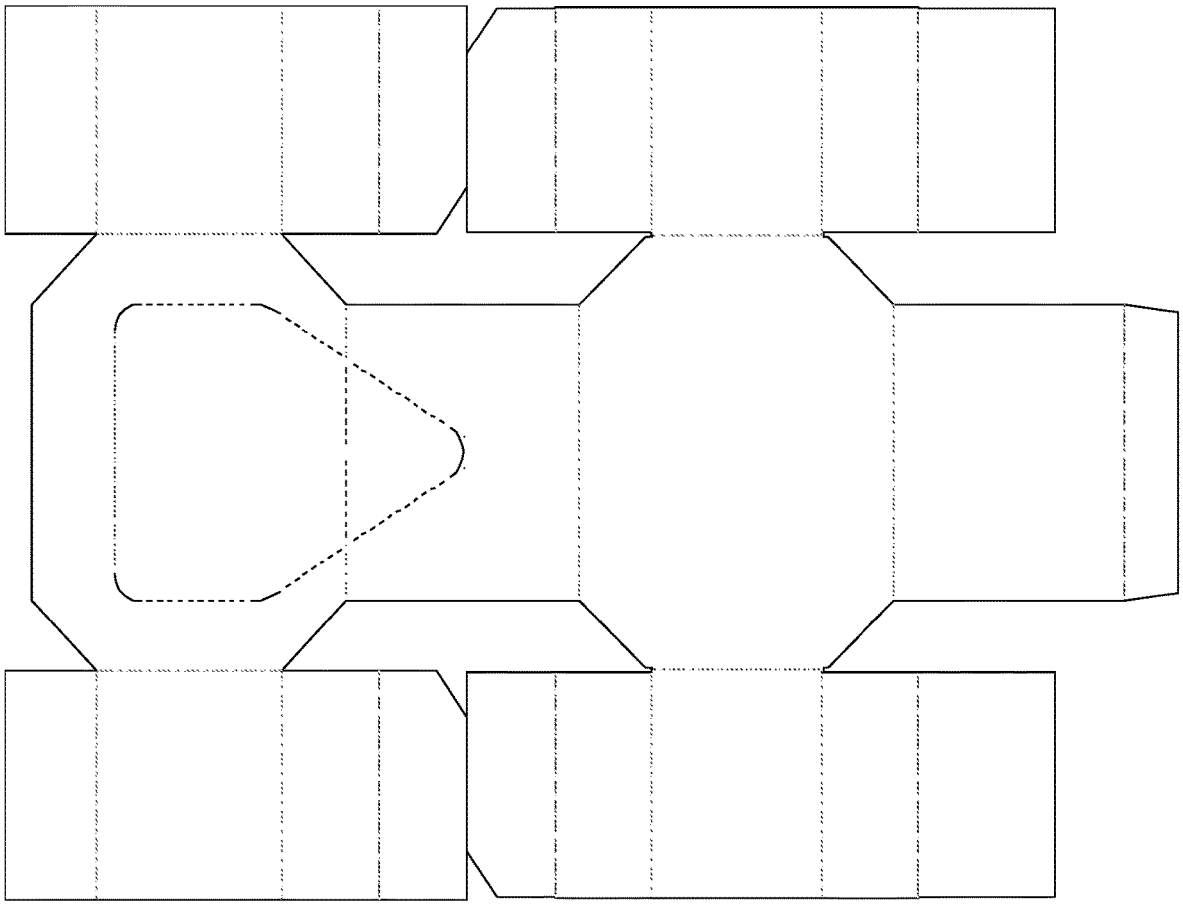
FIG. 17 is a schematic view of an embodiment of a blank accordance with this disclosure.
Figure 18A:
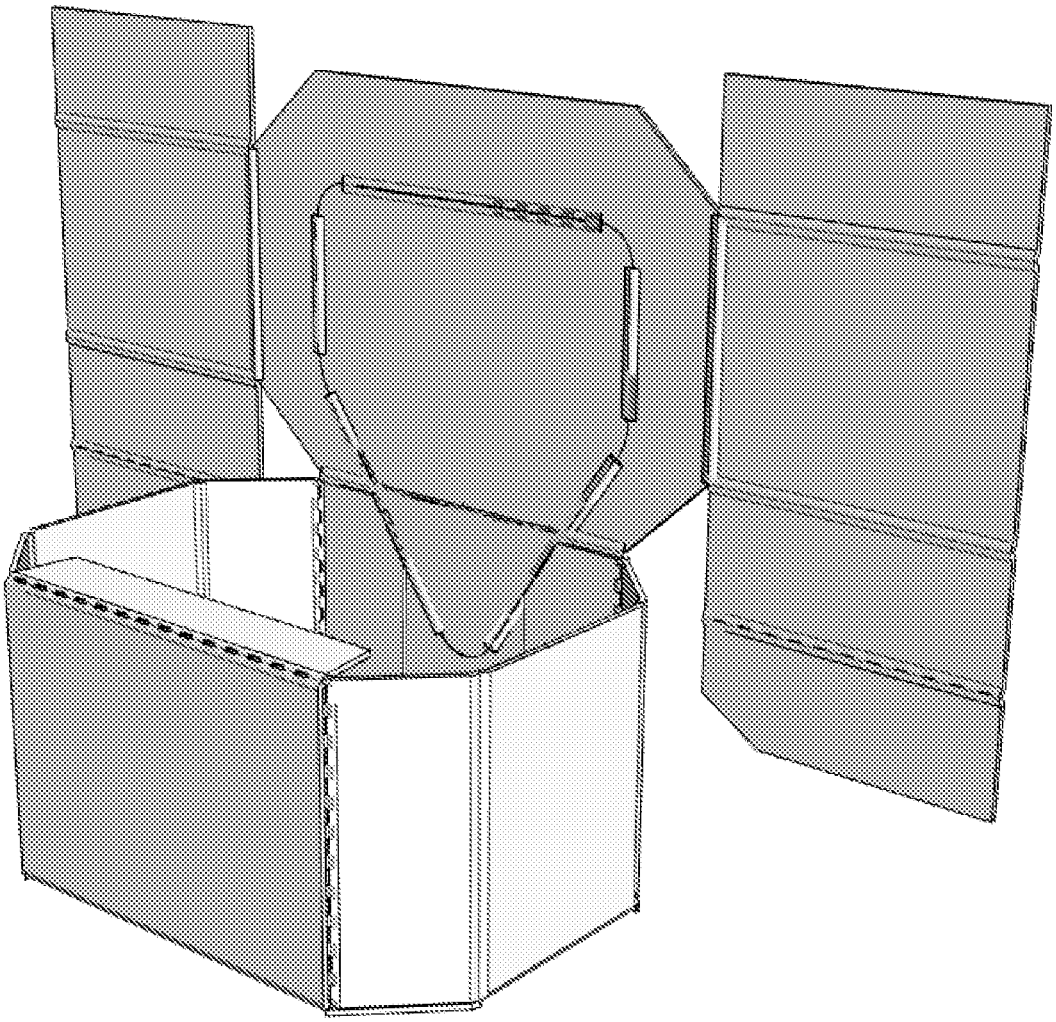
FIGS. 18A and 18B show perspective views of a package formed from the blank of FIG. 17, shown in an open and closed position, respectively.
Figure 18B:
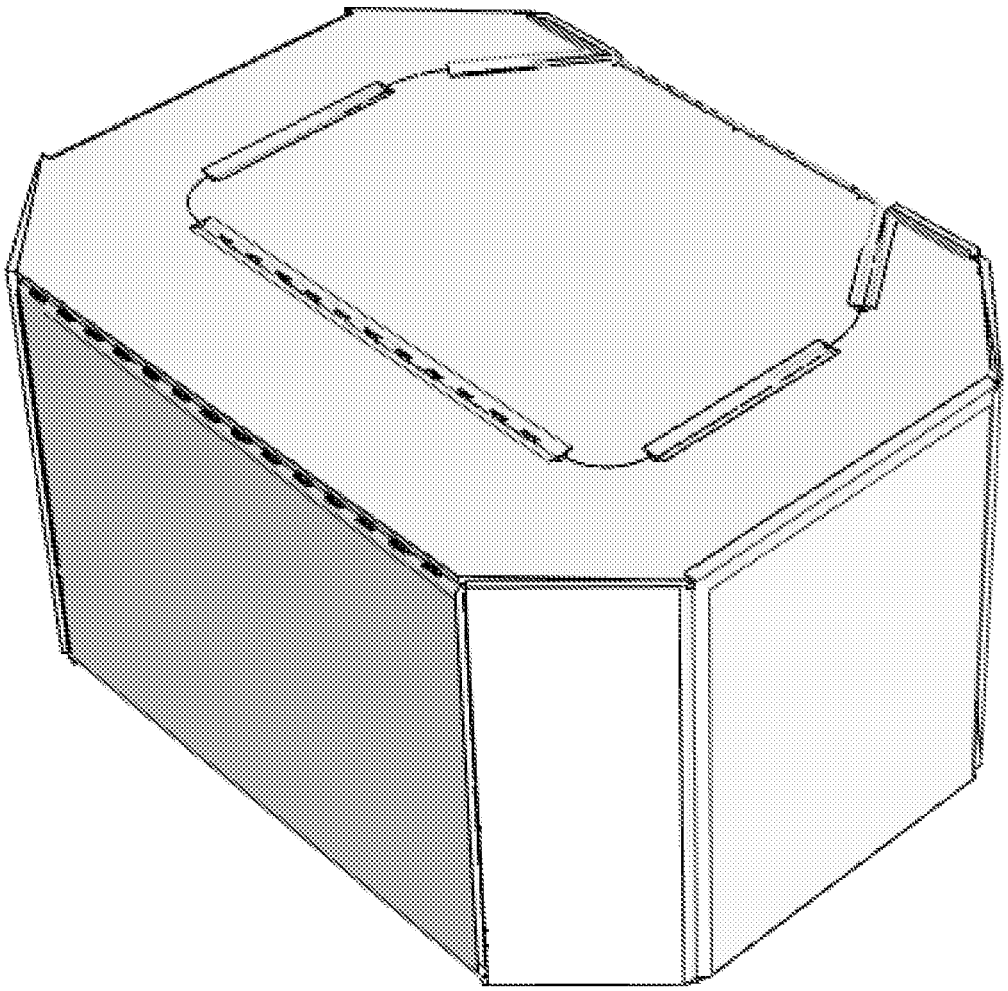

FIG. 13 is a schematic view of an embodiment of a blank 1300 accordance with this disclosure. FIGS. 14A and 14B show perspective views of a package 1400 formed from the blank of FIG. 13, 1300 shown in a closed and torn open position, respectively. FIG. 15 is a schematic view of an embodiment of a blank 1500 accordance with this disclosure. FIGS. 16A and 16B show perspective views of a package 1600 formed from the blank 1500 of FIG. 15, shown in an open and closed position, respectively. FIG. 17 is a schematic view of an embodiment of a blank 1700 accordance with this disclosure. FIGS. 18A and 18B show perspective views of a package 1800 formed from the blank 1700 of FIG. 17, shown in an open and closed position, respectively.

Referring to FIGS. 13-18B, embodiments can include two panel inner minor flaps at each of the corners and the outer flap at the back of the carton, while the front of the carton incorporates only a single angular outside corner flap that is glued in an overlay orientation with the angular inside minor flaps at the front of the carton. This structure results in 14 non-90 degree corners. Such embodiments can allow for a larger (longer) outside glue lap than is achievable with the 16 corner design.

Figure 19:
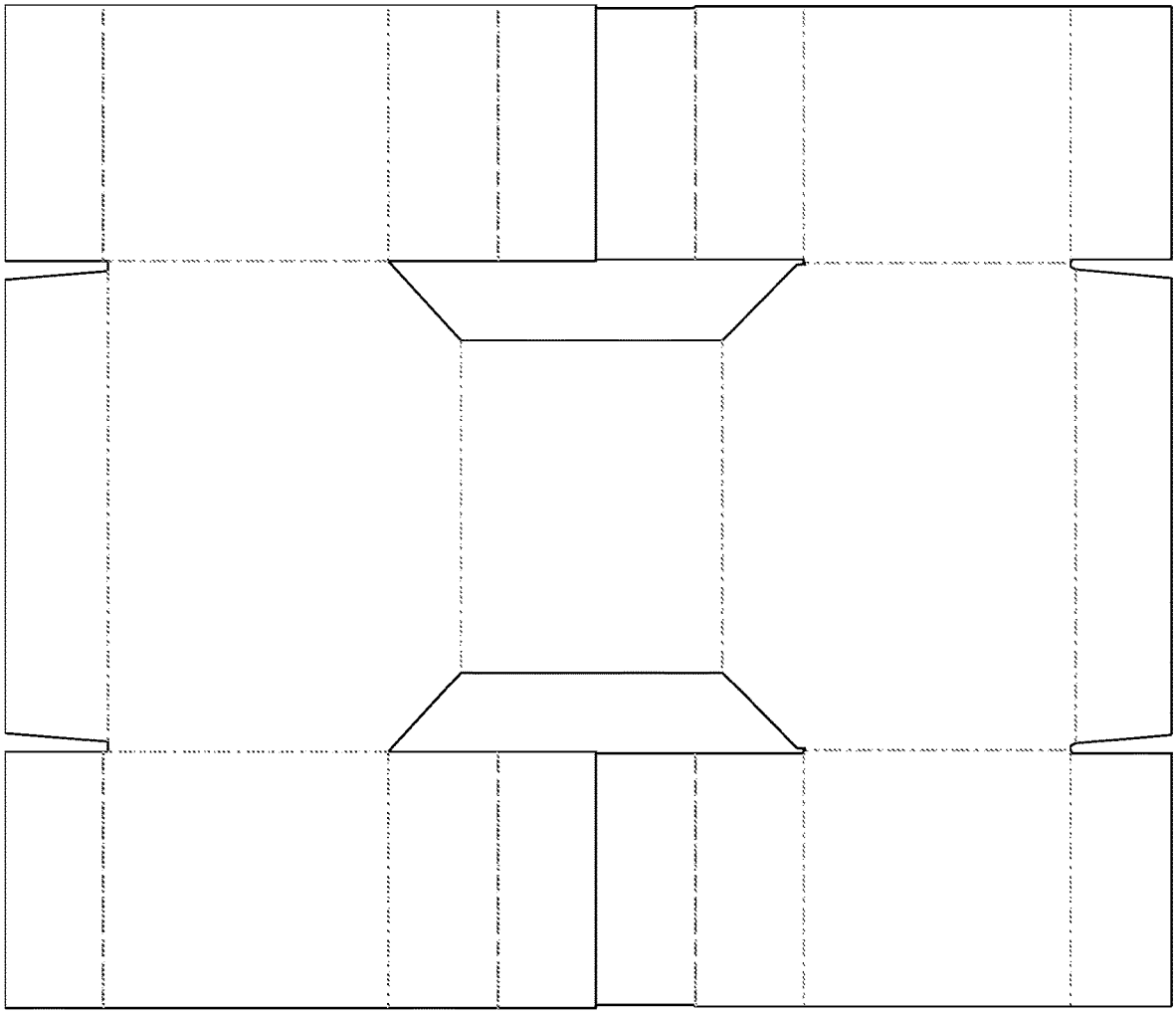
FIG. 19 is a schematic view of an embodiment of a blank accordance with this disclosure.
Figure 20A:
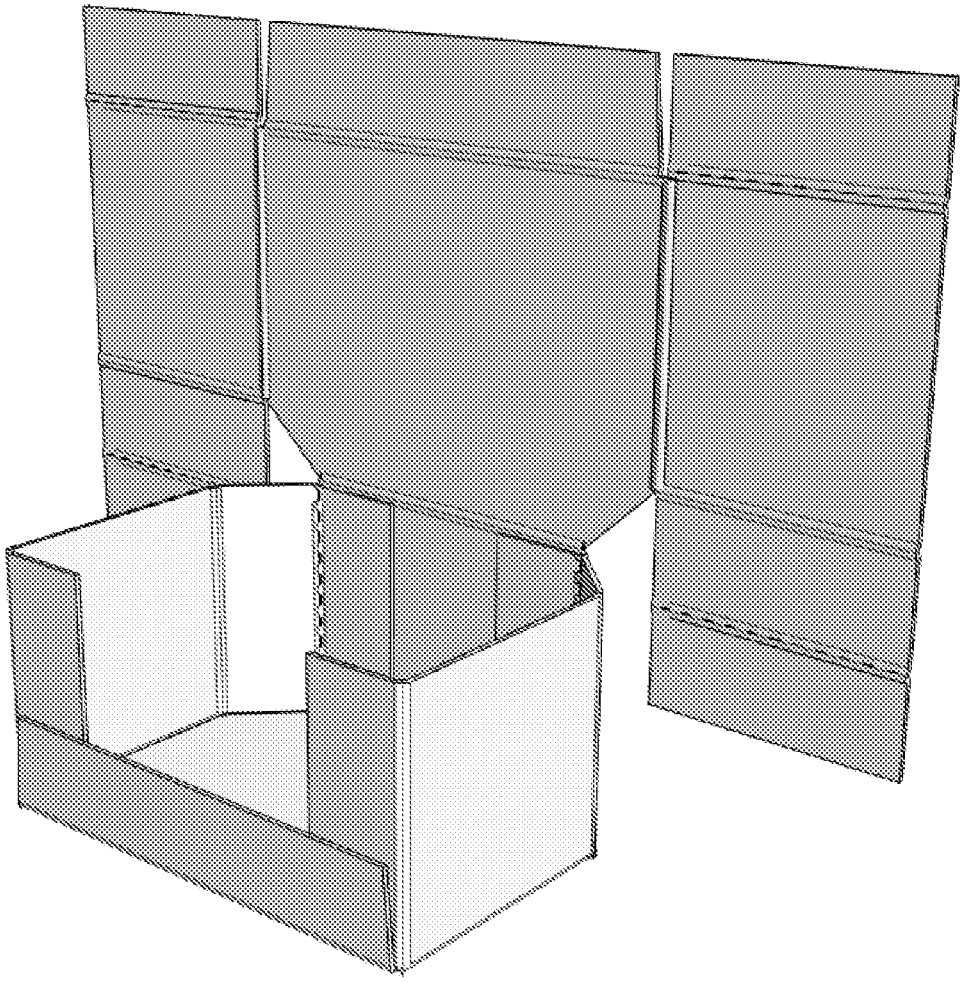
FIGS. 20A and 20B show perspective views of a package formed from the blank of FIG. 19, shown in an open and closed position, respectively.
Figure 20B:
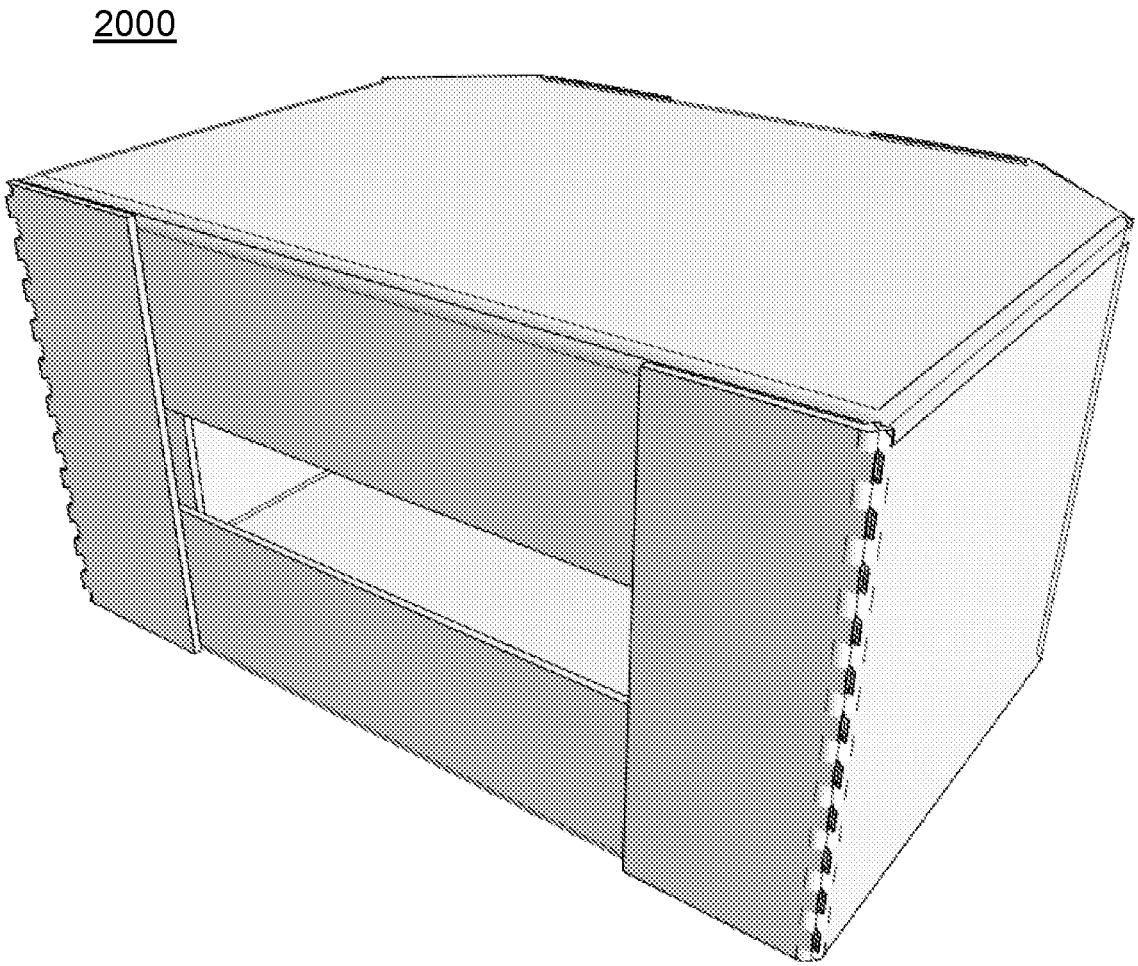
Figure 21:
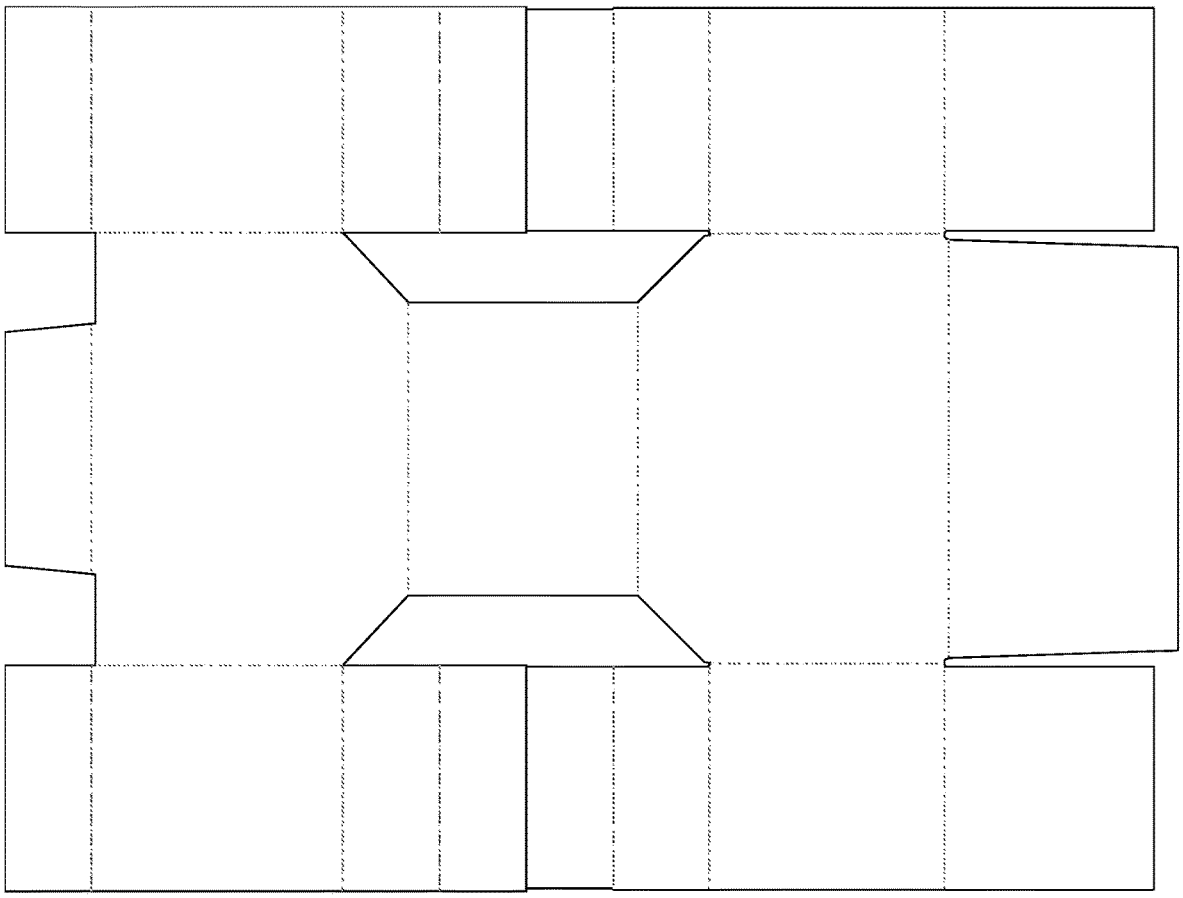
FIG. 21 is a schematic view of an embodiment of a blank accordance with this disclosure.
Figure 22A:
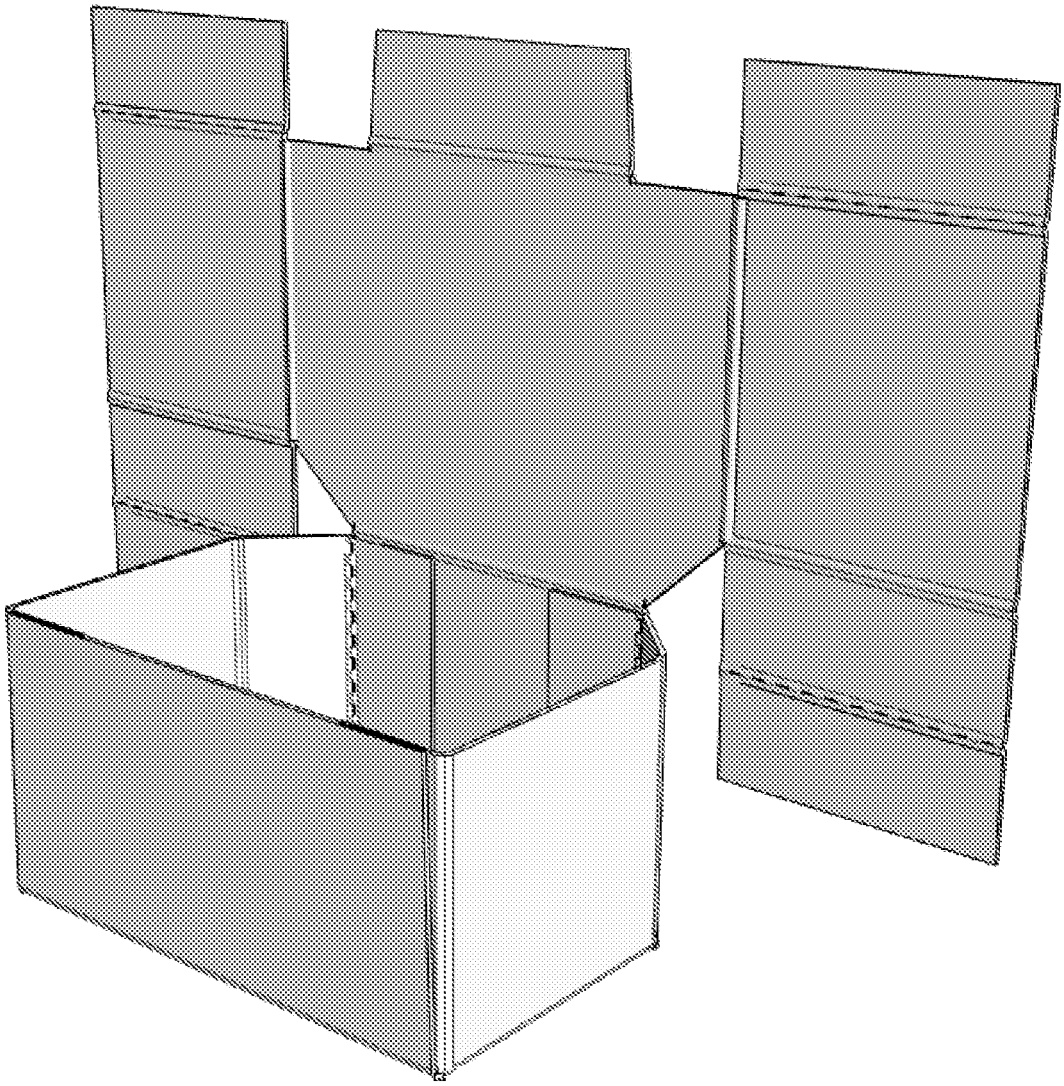
FIGS. 22A and 22B show perspective views of a package formed from the blank of FIG. 21, shown in an open and closed position, respectively.
Figure 22B:
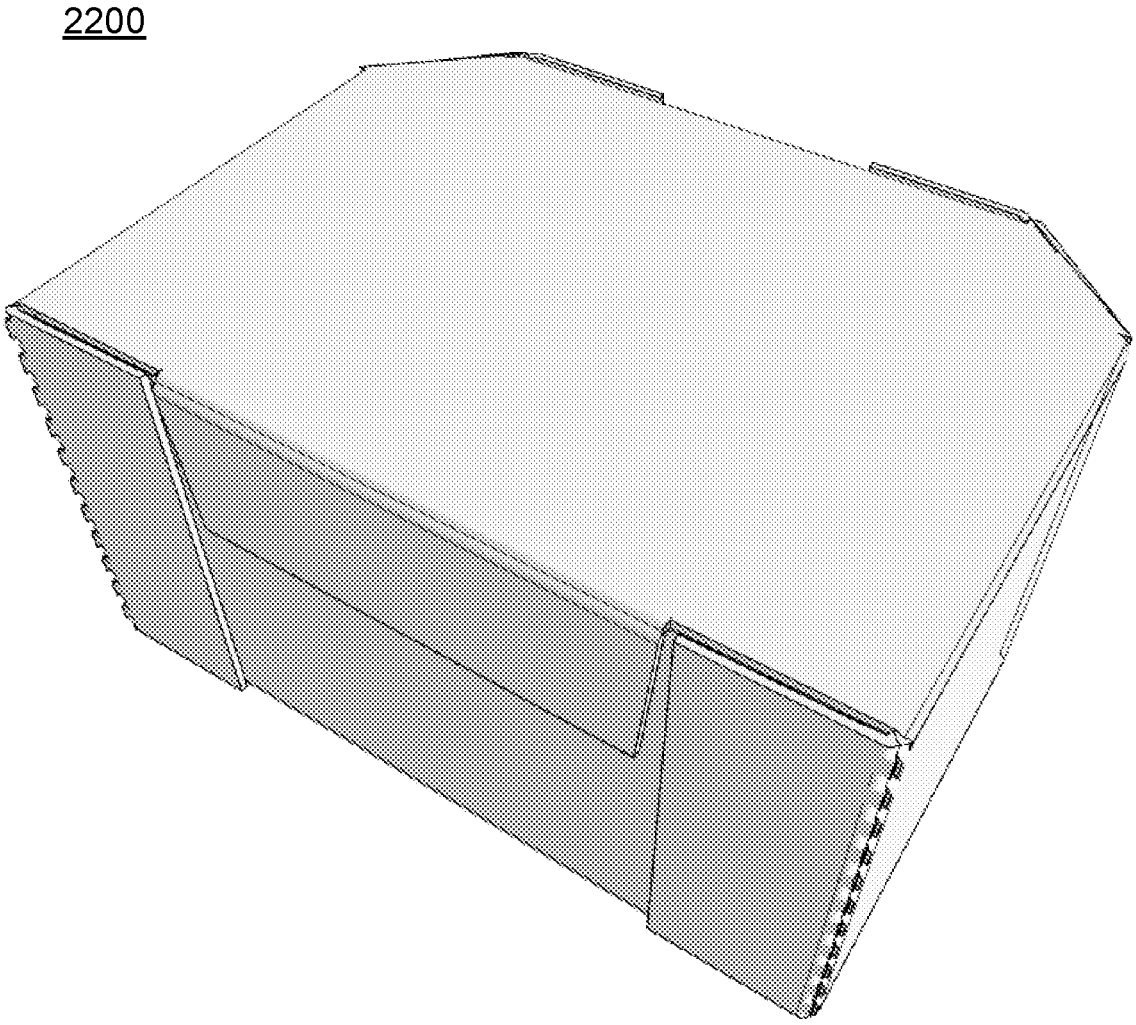
Figure 23:
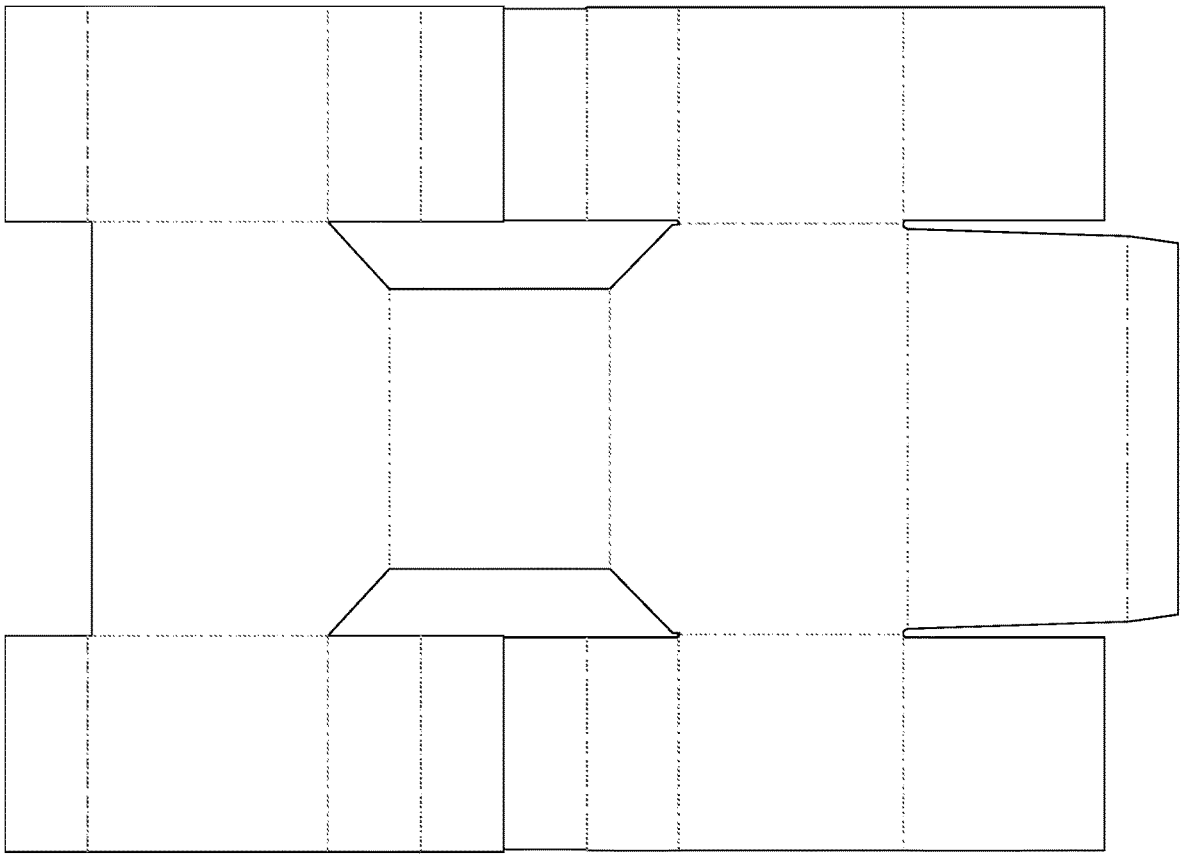
FIG. 23 is a schematic view of an embodiment of a blank accordance with this disclosure.
Figure 24A:
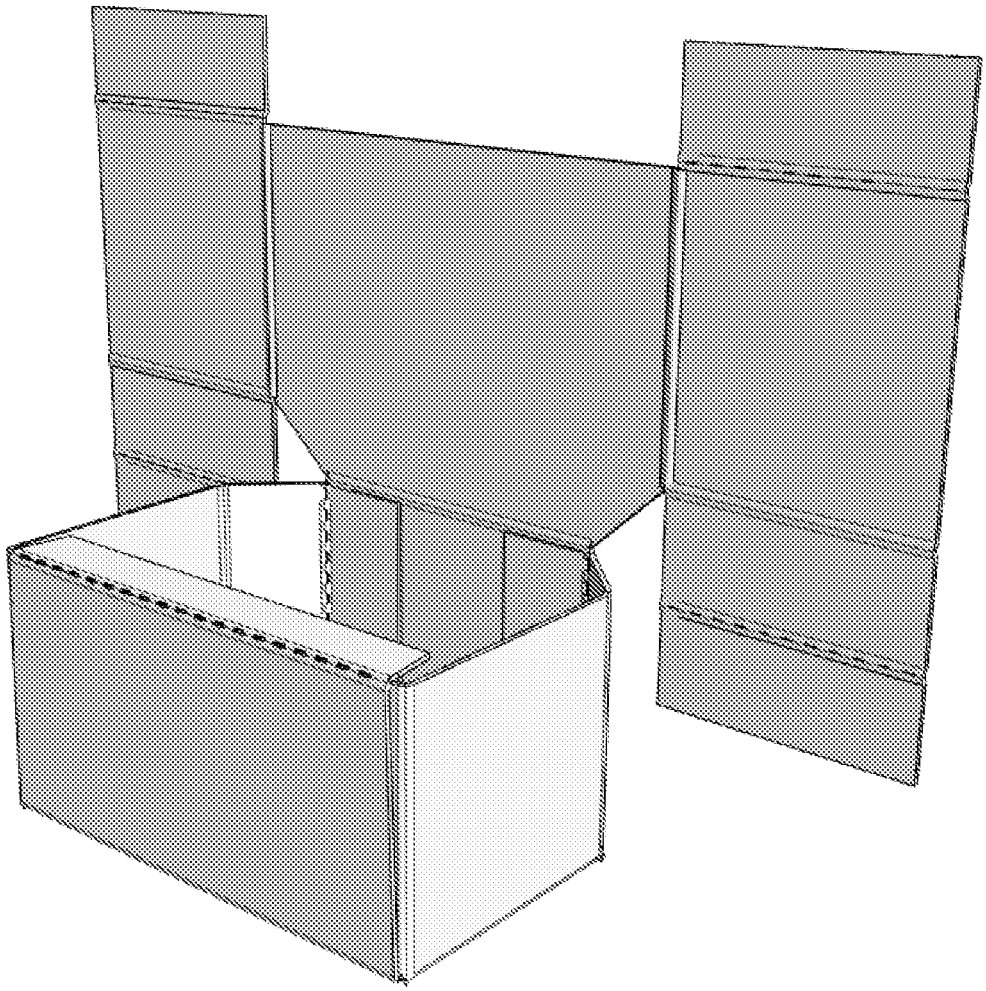
FIGS. 24A and 24B show perspective views of a package formed from the blank of FIG. 23, shown in an open and closed position, respectively.
Figure 24B:
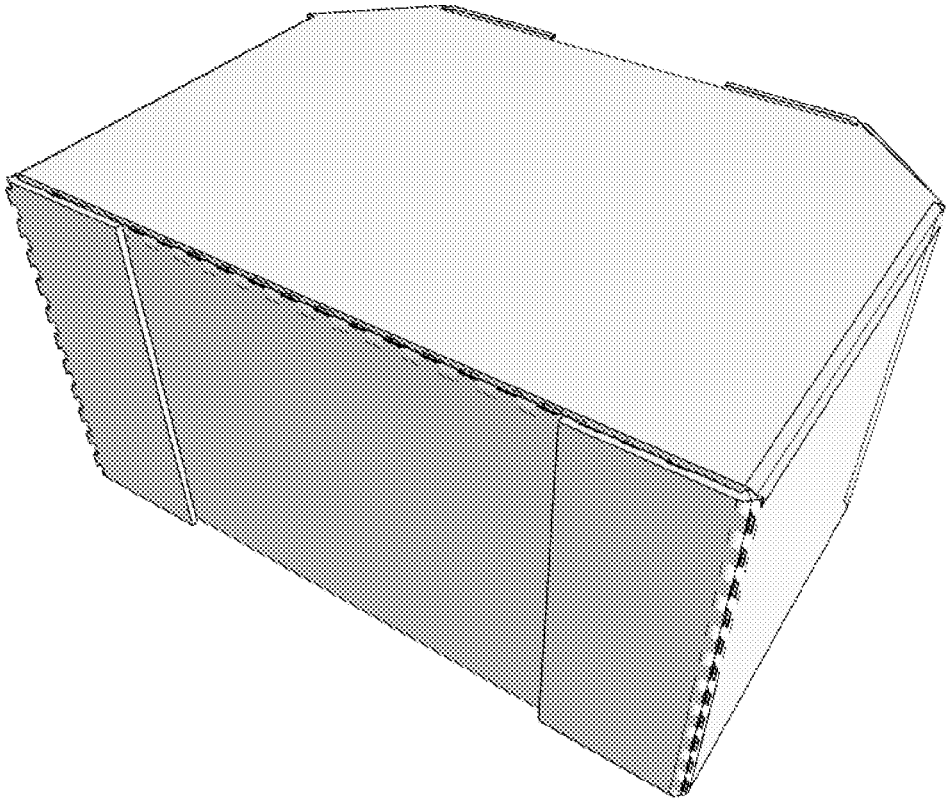
Figure 25:
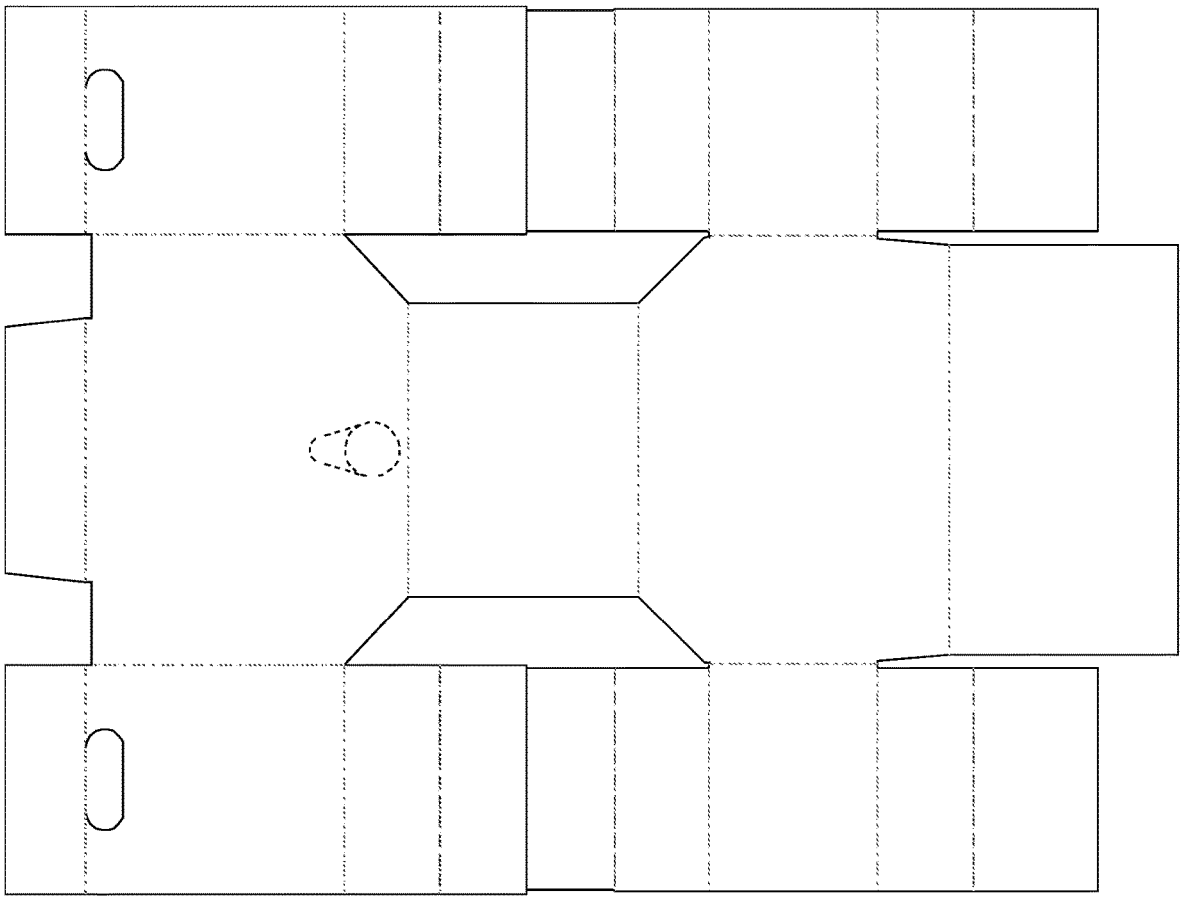
FIG. 25 is a schematic view of an embodiment of a blank accordance with this disclosure.
Figure 26A:
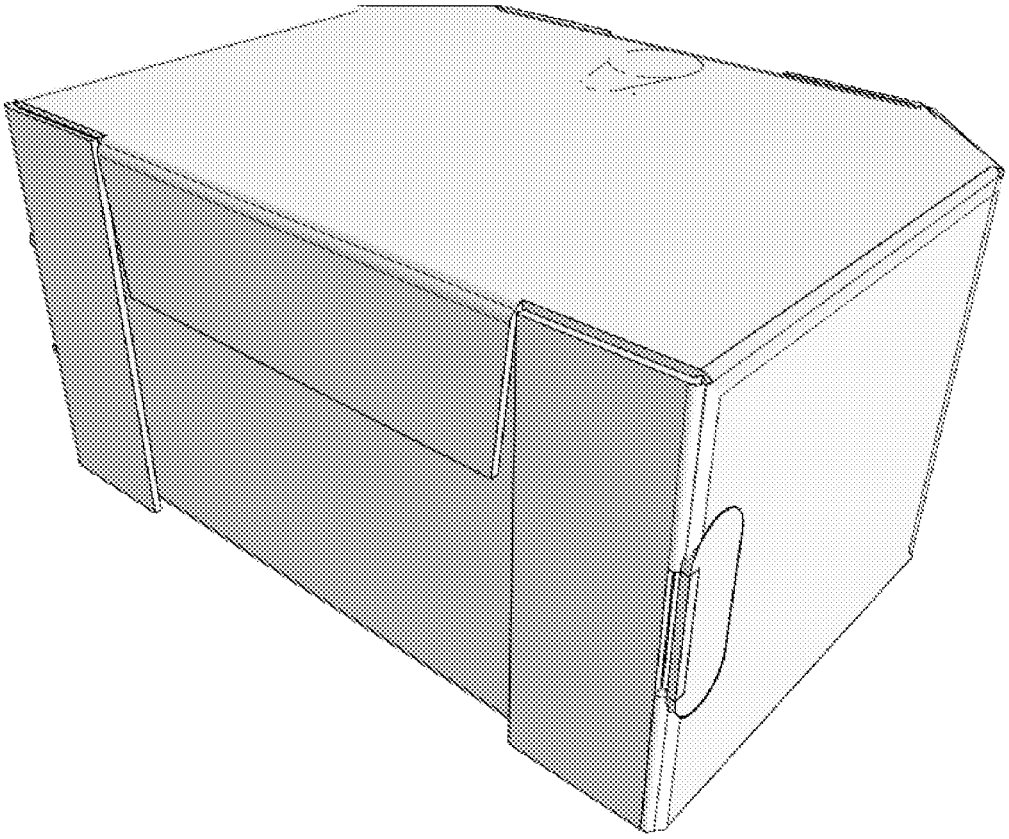
Figure 26B:
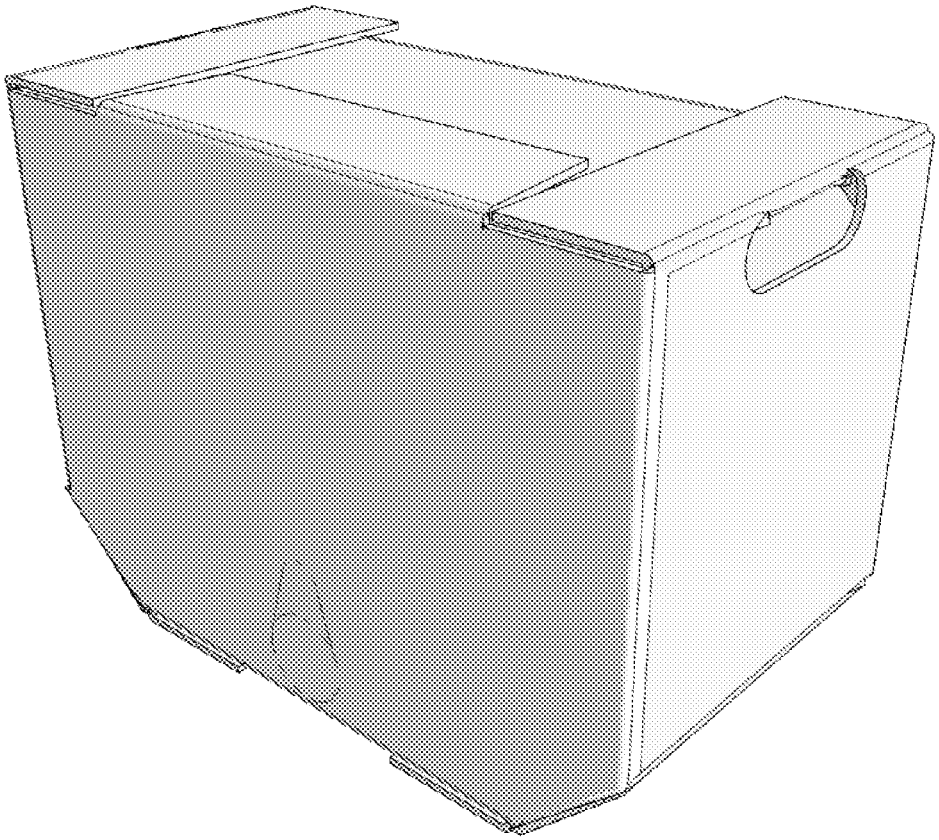
Figure 26C:
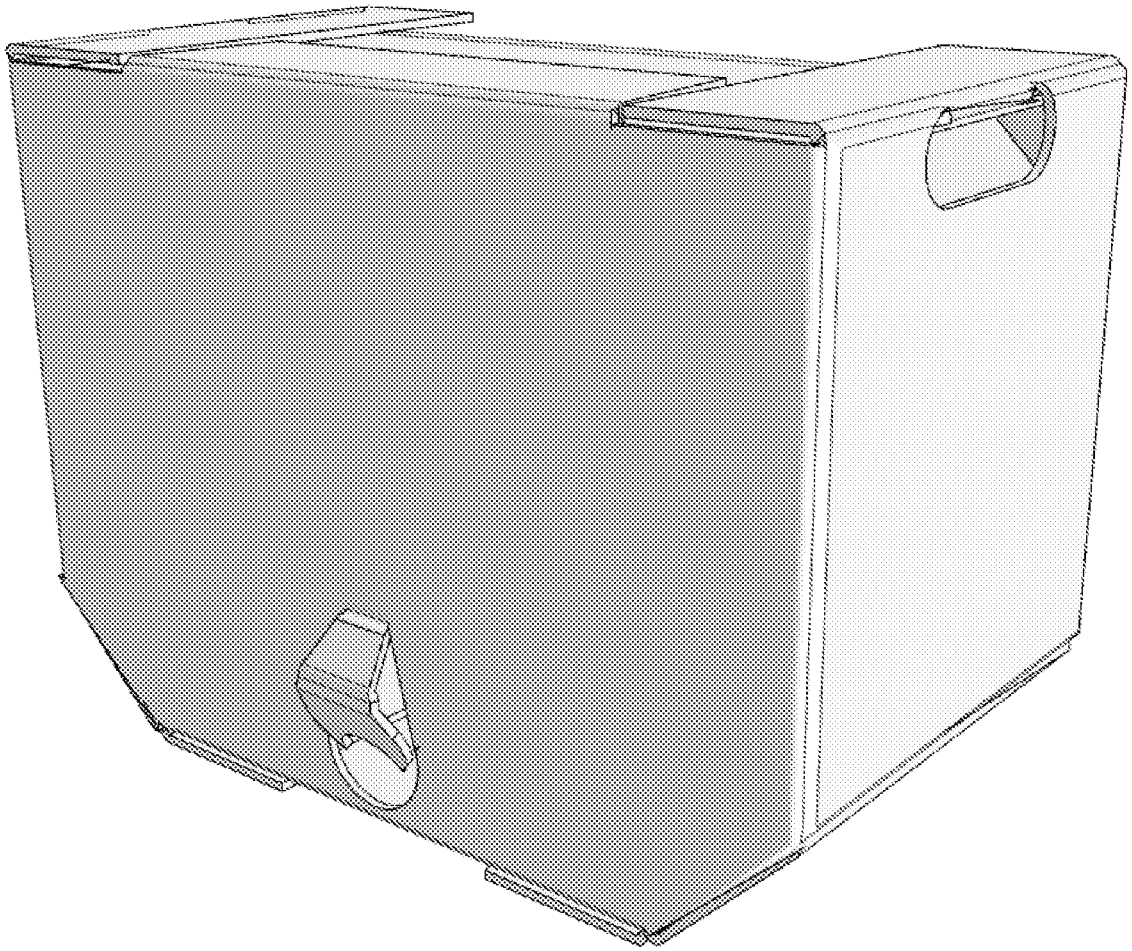
Figure 27:
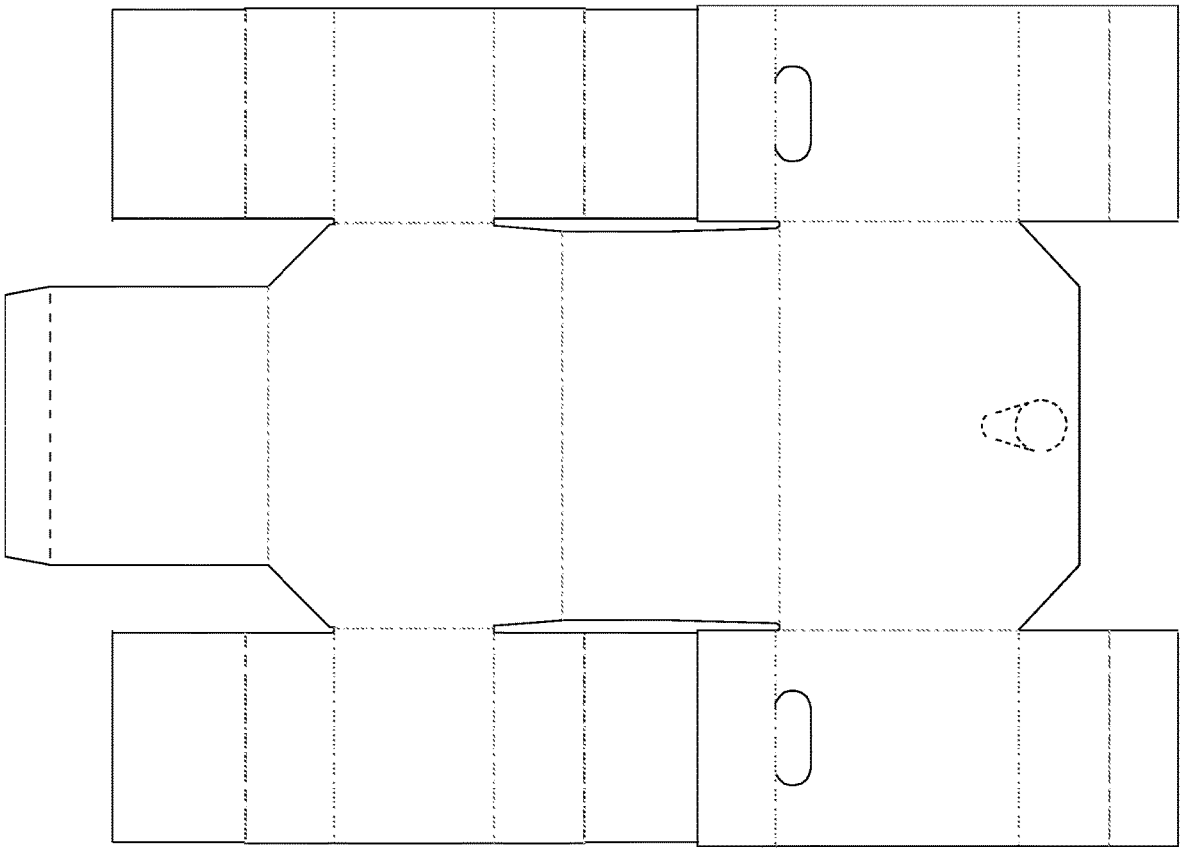
FIG. 27 is a schematic view of an embodiment of a blank accordance with this disclosure.
Figure 28A:
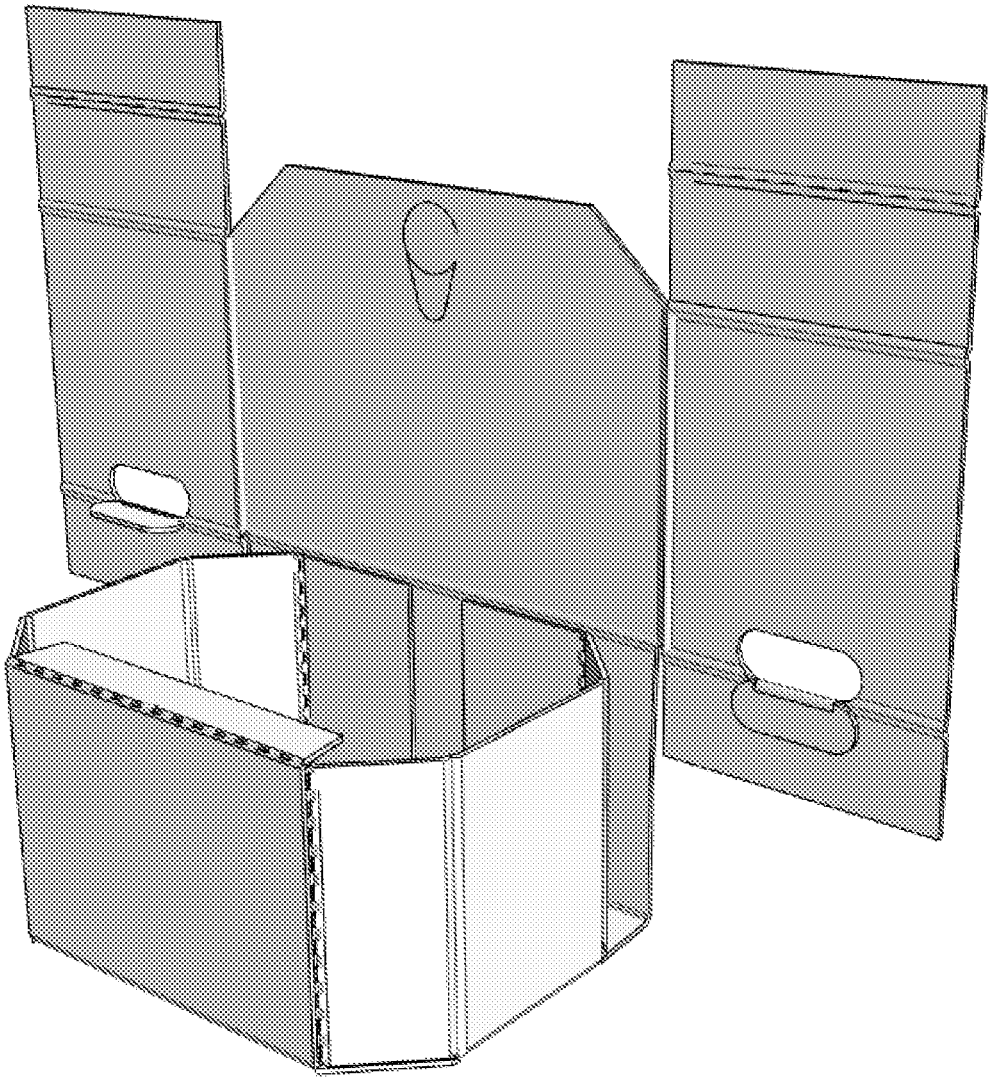
FIGS. 28A and 28B show perspective views of a package formed from the blank of FIG. 27, shown in an open and closed position, respectively.
Figure 28B:
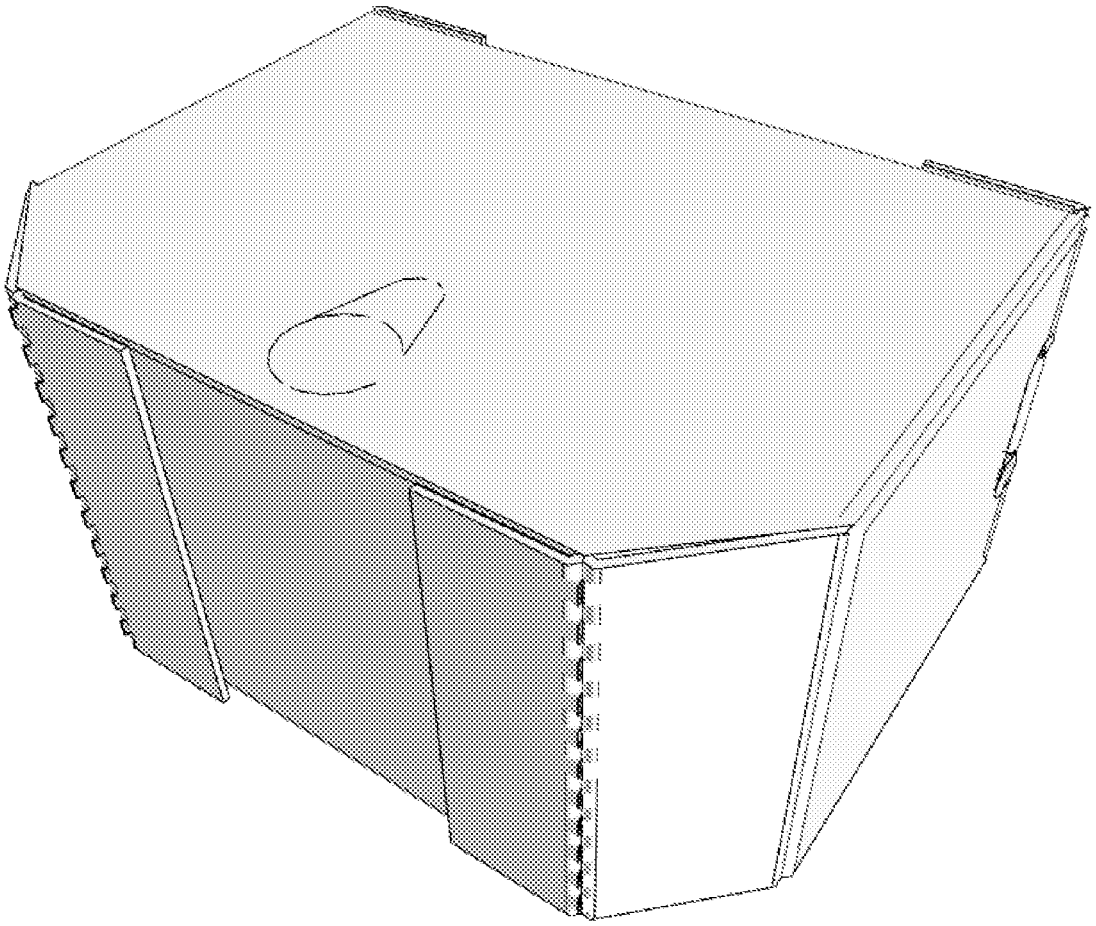

FIG. 19 is a schematic view of an embodiment of a blank 1900 accordance with this disclosure. FIGS. 20A and 20B show perspective views of a package 2000 formed from the blank 1900 of FIG. 19, shown in an open and closed position, respectively. FIG. 21 is a schematic view of an embodiment of a blank 2100 accordance with this disclosure. FIGS. 22A and 22B show perspective views of a package 2200 formed from the blank 2100 of FIG. 21, shown in an open and closed position, respectively. FIG. 23 is a schematic view of an embodiment of a blank 2300 accordance with this disclosure. FIGS. 24A and 24B show perspective views of a package 2400 formed from the blank 2300 of FIG. 23, shown in an open and closed position, respectively. FIG. 25 is a schematic view of an embodiment of a blank 2500 accordance with this disclosure. FIGS. 26A, 26B, and 26C show perspective views of a package 2600 formed from the blank 2500 of FIG. 25, shown in a closed position in different orientations, wherein FIGS. 26B and 26C show handles torn away and punched in such that the package forms an enclosed handle space separate from an interior space of the package. FIG. 27 is a schematic view of an embodiment of a blank 2700 accordance with this disclosure; and FIGS. 28A and 28B show perspective views of a package 2800 formed from the blank 2700 of FIG. 27, shown in an open and closed position, respectively.

As shown in the embodiments of FIGS. 19-28B, embodiments can provide 12 corners, four pairs of internal non-90 degree corners and four separate, external 90 degree corners. Certain embodiments can provide 14 corners (e.g., 8 internal and 6 external). The outside minor flaps can overlay the inside mitered corners on one side of the carton, providing a unique shape. The squared corner flaps can be sandwiched between the length vertical panel and each adhered to this wall. Embodiments can also reversed if desired, for example.

Embodiments disclosed can be used for food, consumer goods, and/or anything that is round and requires stacking support for example. Embodiments allow for shallow, single lid, tray wrap packs that can otherwise be challenged to find enough material to add vertical strength. The octagonal shape can allow for additional corners to be added to the pack, while also offering a non-traditional shape for products that can benefit.

Any suitable adhesive can be applied to any suitable panel disclosed herein for any suitable purpose. Any suitable foldable line types are contemplated herein (e.g., perforated, creased, cut/creased, etc.). While the figures may include a legend indicating the line types of the embodiments of the figures, any other suitable line types for the lines shown in the drawings are contemplated herein. Any other suitable panel arrangement (e.g., more or less panels in any suitable location) is contemplated herein.

While embodiments have been described and shown above, any suitable panels and/or other design for a blank to form a package as disclosed above is contemplated herein. Any suitable material for use (e.g., paper, cardboard, plastic board, etc.) and/or one or more combinations thereof are contemplated herein.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A blank for forming a package, comprising:

a base panel;

a first base side panel foldably connected to the base panel;

a plurality of first base side flaps foldably connected to the first base side panel;

a second base side panel foldably connected to the base panel opposite the first base side panel;

a plurality of second base side flaps foldably connected to the second base side panel;

a hinge panel foldably connected to the base panel;

a top panel foldably connected to the hinge panel;

a first top side panel foldably connected to the top panel;

a plurality of first top side flaps foldably connected to the first top side panel;

a second top side panel foldably connected to the top panel opposite the first top side panel;

a plurality of second top side flaps foldably connected to the second top side panel, wherein an end first base side flap and an end first top side flap are formed and separated by a first cut line such that the end first base side flap and the end first top side flap are abutting each other, and wherein an end second base side flap and an end second top side flap are formed and separated by a second cut line such that the end second base side flap and the end second top side flap are abutting each other, wherein the hinge panel and each side panel have the same length dimension extending away from the base panel and/or the top panel, respectively.

2. The blank of claim 1, wherein the plurality of first and second base side flaps include two side flaps foldably connected to each other on each side of the first and second base side panel, respectively.

3. The blank of claim 2, further comprising a base side panel fold line between each base side panel and the base, further comprising a hinge panel base fold line between the base panel and the hinge panel, wherein each base side panel fold line between each base side panel and the base panel is perpendicular relative to the hinge panel base fold line between the base and the hinge panel.

4. The blank of claim 3, further comprising a base side flap fold line between adjacent base side flaps, and a base side panel flap fold line between each base side panel and each adjacent base side flap, wherein each base side flap fold line and each base side panel flap fold line is parallel with the hinge panel base fold line.

5. The blank of claim 4, wherein the plurality of first and second top side flaps include one top side flap foldably connected to each side of the first and second top side panel, respectively.

6. The blank of claim 5, further comprising a top side panel fold line between each top side panel and the top panel, further comprising a hinge panel top fold line between the top panel and the hinge panel, wherein each top side panel fold line between each top side panel and the top panel is perpendicular relative to the hinge panel top fold line between the top and the hinge panel.

7. The blank of claim 6, further comprising a top side panel flap fold line between each top side panel and each top side flap, wherein each top side panel flap fold line is parallel with the hinge panel top fold line.

8. The blank of claim 7, wherein each top side panel fold line is collinear with a respective base side panel fold line.

9. The blank of claim 8, wherein the base panel and the top panel are the same shape and dimensions.

10. The blank of claim 9, wherein the base panel and the top panel are octagonal.

11. The blank of claim 10, wherein the hinge panel, all side panels, and all side flaps are rectangular.

12. The blank of claim 1, further comprising one or more front side panels foldably connected to the base panel and/or the top panel opposite the hinge panel.

13. The blank of claim 12, wherein the one or more front side panels include a top front panel foldably connected to the top panel, and a base front panel foldably connected to the base panel, the top front panel and base front panel dimensioned to have a combined length dimension extending away from the base panel and the top panel equal to or less than the hinge panel.

14. The blank of claim 13, further comprising tearaway line defined in the top panel and/or the top front panel and/or the base front panel.

15. The blank of claim 12, wherein the one or more front side panels include a top front panel foldably connected to the top panel, and a base front panel foldably connected to the base panel, wherein the base front panel includes a length dimension extending away from the base panel equal to the hinge panel.

16. The blank of claim 12, wherein the one or more front side panels include a base front panel foldably connected to the base panel and an attachment panel foldably connected to the base front panel opposite the base panel, wherein the base front panel includes a length dimension extending away from the base panel equal to the hinge panel.

17. A full overlay (FOL) package formed from the blank of claim 1, comprising:

an octagonal shaped base and has a total of 12 or more weight bearing corners.

18. The FOL package of claim 17, wherein the number of weight bearing corners is 12, 14, or 16.

19. The FOL package of claim 17, wherein the package includes a six sided top panel and having other panels configured to cover the octagonal shaped base such that a handle panel creates a space between a side of the octagonal shaped base and the handle panel to create a finger space for inserting fingers into a handle hole.

* * * * *